US011414930B2

(12) United States Patent
Cho et al.

(10) Patent No.: US 11,414,930 B2
(45) Date of Patent: Aug. 16, 2022

(54) DEFLECTOR ASSEMBLY AND EFFICIENT METHOD FOR MULTI-STAGE FRACTURING A MULTILATERAL WELL USING THE SAME

(71) Applicant: Halliburton Energy Services, Inc., Houston, TX (US)

(72) Inventors: Brian Williams Cho, Katy, TX (US); Matthew James Kelsey, Cypress, TX (US); Loc Phuc Lang, Arlington, TX (US); Stefano Cappiello, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/781,809

(22) Filed: Feb. 4, 2020

(65) Prior Publication Data

US 2020/0256128 A1 Aug. 13, 2020

Related U.S. Application Data

(60) Provisional application No. 62/802,751, filed on Feb. 8, 2019.

(51) Int. Cl.

| | |
|---|---|
| ***E21B 7/06*** | (2006.01) |
| ***E21B 23/00*** | (2006.01) |
| ***E21B 33/124*** | (2006.01) |
| *E21B 31/14* | (2006.01) |
| *E21B 7/10* | (2006.01) |
| *E21B 43/26* | (2006.01) |

(Continued)

(52) U.S. Cl.
CPC ..... *E21B 7/06* (2013.01); *E21B 23/006* (2013.01); *E21B 33/124* (2013.01); *E21B 7/061* (2013.01); *E21B 7/10* (2013.01); *E21B 23/12* (2020.05); *E21B 31/14* (2013.01); *E21B 41/0042* (2013.01); *E21B 43/26* (2013.01)

(58) Field of Classification Search
CPC ... E21B 7/06; E21B 7/10; E21B 31/14; E21B 33/124; E21B 23/006; E21B 43/26; E21B 23/12; E21B 7/061; E21B 41/0042
See application file for complete search history.

(56) References Cited

U.S. PATENT DOCUMENTS 4,431,053 A * 2/1984 Morrow ..... E21B 31/1075 166/117.5
4,979,568 A * 12/1990 Spencer, III ..... E21B 34/102 166/374

(Continued)

FOREIGN PATENT DOCUMENTS

GB 2396632 A 6/2004
RU 2171885 C2 8/2001

(Continued)

*Primary Examiner* — Giovanna Wright
(74) *Attorney, Agent, or Firm* — Scott Richardson; Parker Justiss, P.C.

(57) ABSTRACT

Provided, in one aspect, is a deflector assembly. The deflector assembly, in one embodiment, includes a deflector body having a deflector window located therein, and a deflector ramp positioned at least partially across the deflector window, the deflector ramp configured to move between first (①), second (②) and third (③) different positions when a downhole tool moves back and forth within the deflector body.

20 Claims, 37 Drawing Sheets

(51) Int. Cl.
*E21B 41/00* (2006.01)
*E21B 23/12* (2006.01)

(56) References Cited

U.S. PATENT DOCUMENTS

| | | | | |
|---|---|---|---|---|
| 5,009,273 | A | 4/1991 | Grabinski | |
| 5,950,679 | A * | 9/1999 | Danielson | F16L 37/1215 138/89 |
| 5,964,287 | A * | 10/1999 | Brooks | E21B 23/03 166/117.6 |
| 8,789,590 | B2 | 7/2014 | Donovan | |
| 10,060,225 | B2 | 8/2018 | Wolf et al. | |
| 10,352,140 | B2 | 7/2019 | Partin et al. | |
| 2010/0181113 | A1 | 7/2010 | Watson et al. | |
| 2018/0142534 | A1 | 5/2018 | Mailand et al. | |
| 2018/0283140 | A1* | 10/2018 | Steele | E21B 33/12 |
| 2019/0120021 | A1* | 4/2019 | Steele | E21B 41/0035 |

FOREIGN PATENT DOCUMENTS

| | | | |
|---|---|---|---|
| RU | 2608375 | C2 | 1/2017 |
| RU | 2655517 | C2 | 5/2018 |
| WO | 2018063175 | A1 | 4/2018 |
| WO | 2018125071 | A1 | 7/2018 |

* cited by examiner

DEFLECTOR ASSEMBLY AND EFFICIENT METHOD FOR MULTI-STAGE FRACTURING A MULTILATERAL WELL USING THE SAME

CROSS-REFERENCE TO RELATED APPLICATION

This application claims the benefit of U.S. Provisional Application Ser. No. 62/802,751, filed on Feb. 8, 2019, entitled "METHOD OF MULTISTAGE STIMULATION OF A MULTILATERAL WELL", and incorporated herein by reference in its entirety.

BACKGROUND

The unconventional market is very competitive. The market is trending towards longer horizontal wells to increase reservoir contact. Multilateral wellbores offer an alternative approach to maximize reservoir contact. Multilateral wellbores include one or more lateral wellbores extending from a main wellbore. A lateral wellbore is a wellbore that is diverted from the main wellbore.

A multilateral wellbore can include one or more windows or casing exits to allow corresponding lateral wellbores to be formed. The window or casing exit for a multilateral wellbore can be formed by positioning a whipstock assembly in a casing string with a running tool at a desired location in the main wellbore. The whipstock assembly may be used to deflect a window mill relative to the casing string. The deflected window mill penetrates part of the casing joint to form the window or casing exit in the casing string and is then withdrawn from the wellbore. Drill assemblies can be subsequently inserted through the casing exit in order to cut the lateral wellbore, fracture the lateral wellbore, and/or service the lateral wellbore.

SUMMARY

Provided, in one aspect, is a deflector assembly. The deflector assembly, in one embodiment, includes a deflector body having a deflector window located therein, and a deflector ramp positioned at least partially across the deflector window, the deflector ramp configured to move between first (①), second (②) and third (③) different positions when a downhole tool moves back and forth within the deflector body.

BRIEF DESCRIPTION

Reference is now made to the following descriptions taken in conjunction with the accompanying drawings, in which:

FIGS. 3A and 3B through 11A and 11B illustrate different views of a deflector assembly designed and manufactured according to at least one embodiment of the disclosure at various stages of operation;

DETAILED DESCRIPTION

A subterranean formation containing oil and/or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased (e.g., open-hole) portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore. As used herein, "into a well" means and includes into any portion of the well, including into the wellbore or into the near-wellbore region via the wellbore.

While a main wellbore may in some instances be formed in a substantially vertical orientation relative to a surface of the well, and while the lateral wellbore may in some instances be formed in a substantially horizontal orientation relative to the surface of the well, reference herein to either the main wellbore or the lateral wellbore is not meant to imply any particular orientation, and the orientation of each of these wellbores may include portions that are vertical, non-vertical, horizontal or non-horizontal. Further, the term "uphole" refers a direction that is towards the surface of the well, while the term "downhole" refers a direction that is away from the surface of the well.

Figure 1:
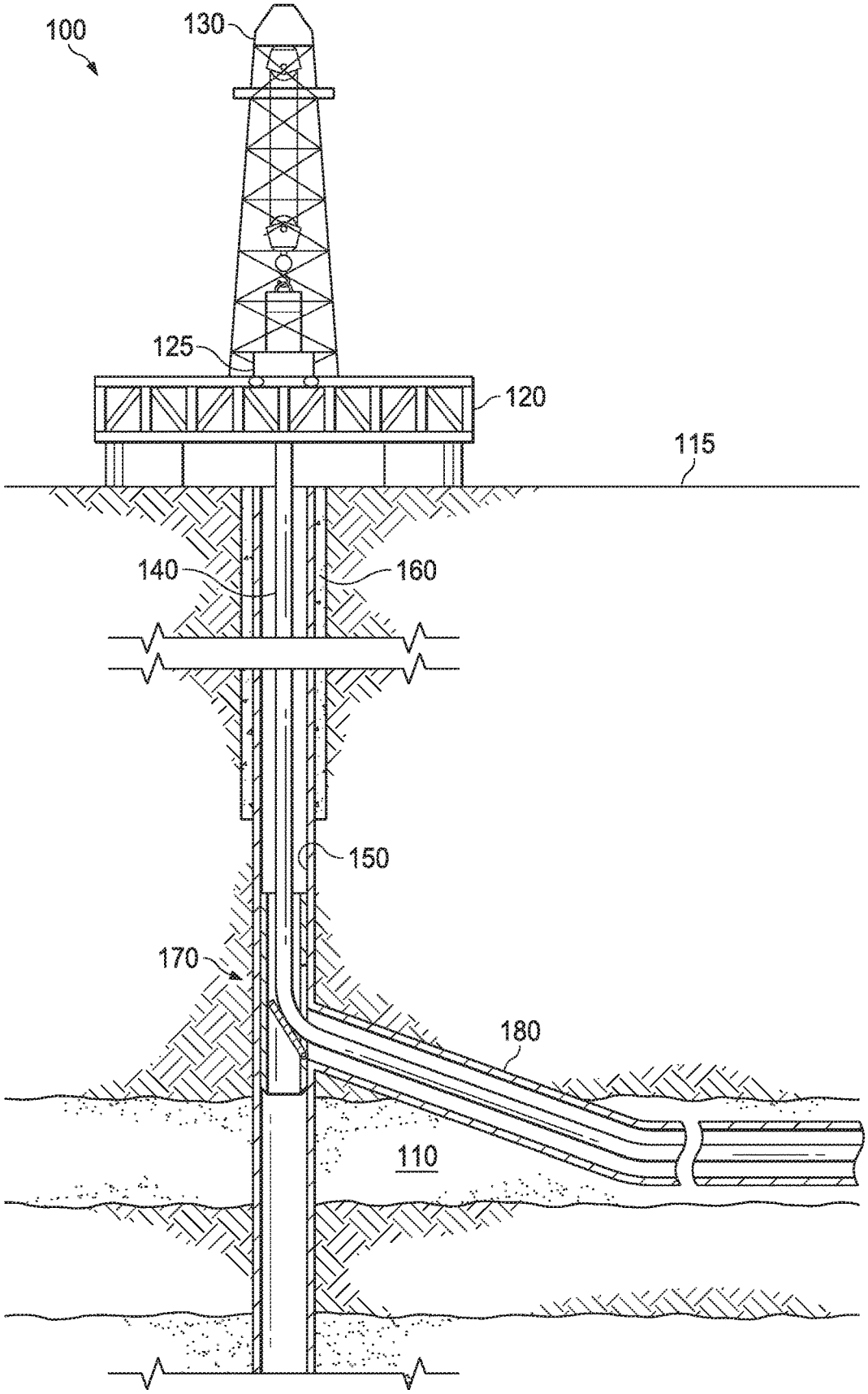
FIG. 1 is a schematic view of a multilateral well according to one or more embodiments disclosed herein.

FIG. 1 is a schematic view of a multilateral well 100 according to one or more embodiments disclosed herein. The multilateral well 100 includes a platform 120 positioned over an oil and gas formation 110 located below the earth's surface 115. The platform 120, in at least one embodiment, has a hoisting apparatus 125 and a derrick 130 for raising and lowering pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based oil and gas systems and/or offshore oil and gas systems different from that illustrated.

As shown, a main wellbore 150 has been drilled through the various earth strata, including the formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150.

The term "casing" is used herein to designate a tubular string used to line a wellbore. Casing may actually be of the type known to those skilled in the art as "liner" and may be made of any material, such as steel or composite material and may be segmented or continuous, such as coiled tubing.

A deflector assembly 170 according to the present disclosure may be positioned at a desired intersection between the main wellbore 150 and a lateral wellbore 180. The term "lateral" wellbore is used herein to designate a wellbore that is drilled outwardly from its intersection with another wellbore, such as a main wellbore. Moreover, a lateral wellbore may have another lateral wellbore drilled outwardly therefrom. The deflector assembly 170, in accordance with at least one embodiment, cycles between through bore access and lateral bore access to minimize trips in and out of the well by. Such a deflector assembly 170 allows accessing all the laterals in any order and as many times as necessary on a single trip, and even allows access to all laterals in subsequent well intervention as necessary.

Installing a deflector assembly 170 for each lateral wellbore significantly reduces the pipe trips to access laterals. This trip reduction is multiplied across 3 construction phases. For example, in the junction construction phase, the deflector assembly 170 allows the liner to be deflected into the lateral. This feature allows for a unique level 3 junction construction. In the stimulation phase, the deflector assembly 170 allows entry into all laterals in any order for stimulation on a single pipe trip. In the clean-up phase, the deflector assembly 170 allows entry into all laterals in any order for clean up on a single pipe trip.

Figure 2A:
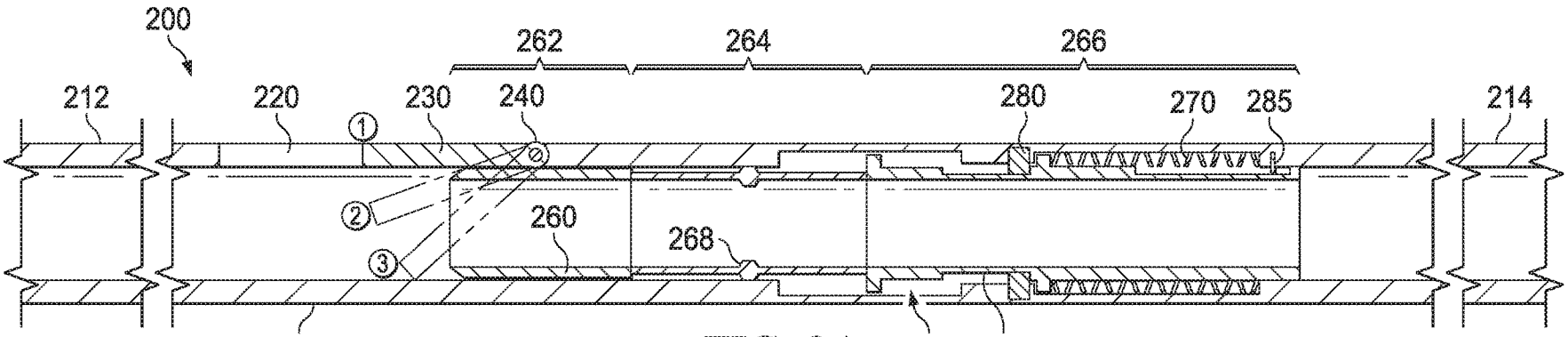
FIGS. 2A-2C illustrate one embodiment of a deflector assembly designed, manufactured and operated according to the disclosure.

Turning to FIG. 2A, illustrated is one embodiment of a deflector assembly 200 designed, manufactured and operated according to the disclosure. The deflector assembly 200 initially includes a deflector body 210. The deflector body 210, in the illustrated embodiment, comprised metal or another sturdy material and includes a throated neck section 212 that functions as a running tool interface, and a lower section 214 with an optional locating/orienting latch. The deflector assembly 200, in the embodiment of FIG. 2A, additionally includes a deflector window 220 located within the deflector body 210.

Positioned at least partially across the deflector window 220 (e.g., over and/or within) is a deflector ramp 230. The deflector ramp 230, in the illustrated embodiment, is a structural member with the strength and rigidity capable of deflecting one or more different types of assemblies out the lateral wellbore. While the deflector ramp 230 illustrated in FIG. 2A has a straight profile, other embodiments may exist wherein the deflector ramp 230 includes a sloped and or arced profile.

The deflector ramp 230, in one example embodiment, is hinged at a downhole end of the deflector window 220. Accordingly, the deflector ramp 230 may rotate into and out of the deflector body 210 about the hinged connection at the downhole end of the deflector window 220. In certain embodiments, a deflector ramp spring 240 (e.g., coil spring in one embodiment) is configured to bias the deflector ramp 230 toward an interior of the deflector body 210, or the closed position. The closed position is defined as the rotated position where the deflector ramp 230 is substantially obstructing an ID of the deflector body 210. In the closed position, everything that hits the deflector ramp 230 is deflected through the deflector window 220 and out the lateral wellbore.

The deflector assembly 200, in the illustrated embodiment, has an actuation member 250 configured to control a position of the deflector ramp 230 between multiple different possible positions (e.g., the first (①), second (②) and third (③) positions illustrated in FIG. 2A). The actuation member 250, in one embodiment, includes an inner sleeve 260 that linearly slides along an interior surface of the deflector body 210. The inner sleeve 260 may be a single continuous inner sleeve as illustrated in FIG. 2A, or alternatively may be made of multiple different inner sleeves. The inner sleeve 260, in accordance with one embodiment of the disclosure, includes an uphole section 262, a collet section 264 (e.g., which may flex radially inward and/or radially outward), and a downhole section 266. The collect section 264, in the illustrated embodiment, includes a shifting profile 268 extending radially inward therefrom. The shifting profile 268, as those skilled in the art appreciate, is configured to catch on a downhole tool traversing an interior of the deflector body 210, and thus radially shift the inner sleeve 260 (e.g., downhole).

The deflector assembly 200, in the illustrated embodiment of FIG. 2A, additionally includes an inner sleeve spring 270 positioned between the deflector body 210 and a profile of the inner sleeve 260. The inner sleeve spring 270, in the illustrated embodiment, is configured to bias the inner sleeve 260 toward the deflector ramp 230, when allowed. The deflector assembly 200, in the illustrated embodiment of FIG. 2A, additionally includes a cycle ring 280 (e.g., a rotating cycle ring 280) that is linearly fixed with the deflector body 210. The cycle ring 280 illustrated in FIG. 2A, however, is allowed free rotation about the deflector body 210. The deflector assembly 200 illustrated in the embodiment of FIG. 2A additionally includes a spline pin 285 that rotationally fixes the inner sleeve 260 relative to the deflector body 210, but allowed linear translation of the inner sleeve 260 relative to the deflector body 210.

Figure 2B:
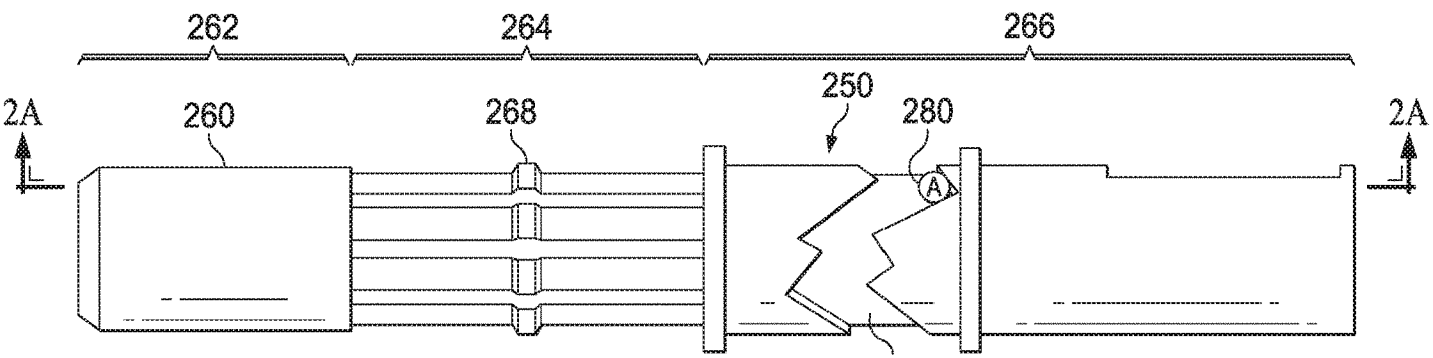

Turning briefly to FIG. 2B, illustrated is a perspective view of the inner sleeve 260 shown in FIG. 2A. As is illustrated in FIG. 2B, the inner sleeve 260 includes a slot 267 (e.g., a J-slot in one or more embodiments) configured to engage with the cycle ring 280. Thus, as the inner sleeve 260 linearly moves uphole and downhole within the deflector body 210, the cycle ring 280 rotates to follow the contours in the slot 267. Accordingly, the slot 267 and cycle ring 280 provide uphole and downhole limits on the linear translation of the inner sleeve 260. While the cycle ring 280 does rotate within the deflector body 210 in the embodiment of FIGS. 2A and 2B, the inner sleeve 260 is rotationally fixed (e.g., by way of the spline pin 285) with the deflector body 210. In an alternative embodiment, the slot 267 is located within the deflector body 210, and the cycle ring 280 is linearly fixed (but rotationally free) within the inner sleeve 260.

Figure 2C:
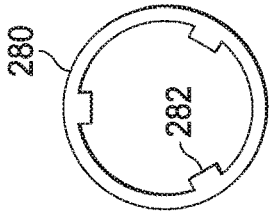

Turning briefly to FIG. 2C, illustrated is a perspective view of at least one embodiment of the cycle ring 280. The cycle ring 280, in the illustrated embodiment, includes one or more protrusions 282 extending radially inward therefrom. While the cycle ring 280 illustrated in FIG. 2C includes three protrusions 282, other embodiments may use more or less than three protrusions 282 and remain within the scope of the disclosure.

In one or more embodiments, the inner sleeve 260 is used to help control the position of the deflector ramp 230 (e.g., between the first (①), second (②) and third (③) illustrated positions). When the inner sleeve 260 is in the run-in-hole position, the inner sleeve 260 props the deflector ramp 230 in the first open (①) position. When the deflector ramp 230 is in the first open (①) position, the deflector body 210 ID is generally (e.g., completely) unobstructed. When a downhole tool passes through the deflector assembly 200, the downhole tool catches on the shifting profile 268 in the collect section 264, and thus linearly shifts the inner sleeve 260 away from the deflector ramp 230. In this positon, the inner sleeve 260 allows the deflector ramp 230 to rotate toward the second (②) partially closed position. If the downhole tool were still in the deflector assembly 200, the deflector ramp 230 would likely be resting on the downhole tool, and thus the deflector ramp 230 would not be fully positioned at the second (②) partially closed position. A recess in the deflector body 210 allows the collet section 264 to flex outward allowing the downhole tool pass through the deflector assembly 200. After the downhole tool has performed its intended task, the downhole tool may be withdrawn partially or entirely out of the well. Once the downhole tool is pulled uphole past the deflector ramp 230, the deflector ramp 230 fully moves to the second (②) partially closed position.

With the deflector ramp 230 fully in the second (②) partially closed position, any downhole tool that is shifted downhole will push the deflector ramp 230 to the third (③) fully closed position and deflect off the deflector ramp 230 into the lateral wellbore. The action of pushing the deflector ramp 230 to the third (③ fully closed position shifts the inner sleeve 260 further away from the deflector ramp 230. Once the downhole tool is pulled out of the lateral wellbore, the deflector ramp 230 is returned to the first open (①) position by the inner sleeve 260 and the inner sleeve spring 290. In accordance with this embodiment, a spring force of the inner sleeve spring 290 may be greater than a spring force of the deflector ramp spring 240. The cycle starts over by sending another downhole tool toward the deflector assembly 200.

Figure 3A:
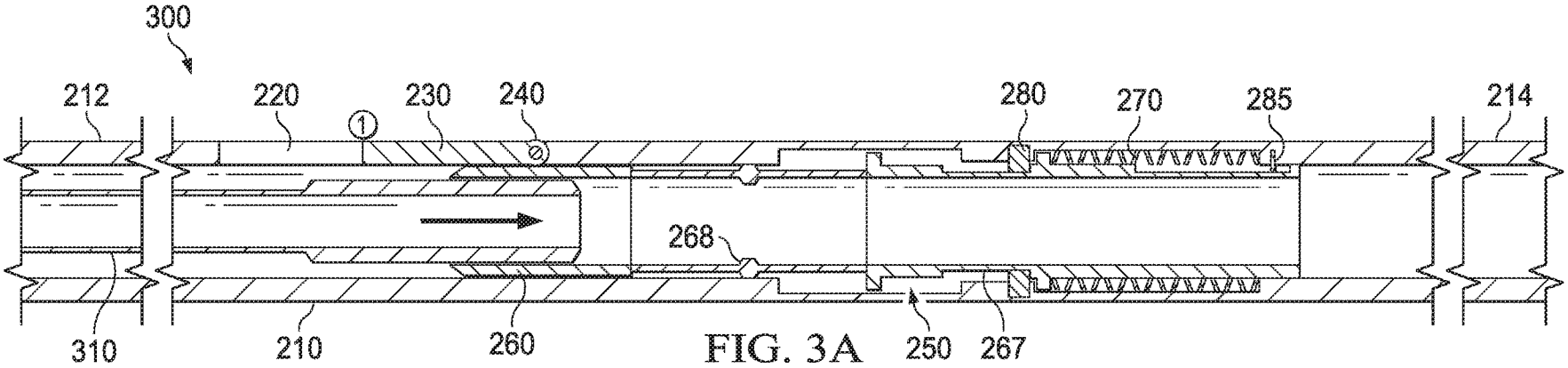
Figure 3B:
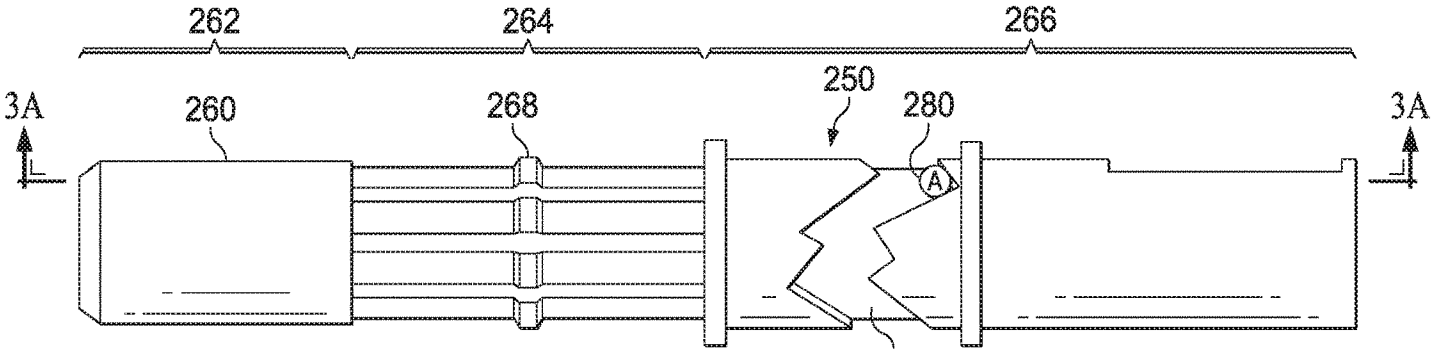

Turning now to FIGS. 3A and 3B through 11A and 11B, illustrated are different views of a deflector assembly 300 designed and manufactured according to at least one embodiment of the disclosure at various stages of operation. The deflector assembly 300 is similar in many respects to the deflector assembly 200 discussed above. Accordingly, like reference numbers have been used to represent similar, if not identical, features. With initial reference to FIGS. 3A and 3B, the deflector assembly 300 is in the run-in-hole orientation. Accordingly, the inner sleeve 260 is linearly positioned such that the protrusion 282 in the cycle ring 280 are located in the (Ⓐ) position in the slot 267, which in turn positions the deflector ramp 230 in the first open (①) position. With the deflector ramp 230 is in the first open (①) position, a downhole tool 310 is free to slide past the deflector ramp 230.

Figure 4A:
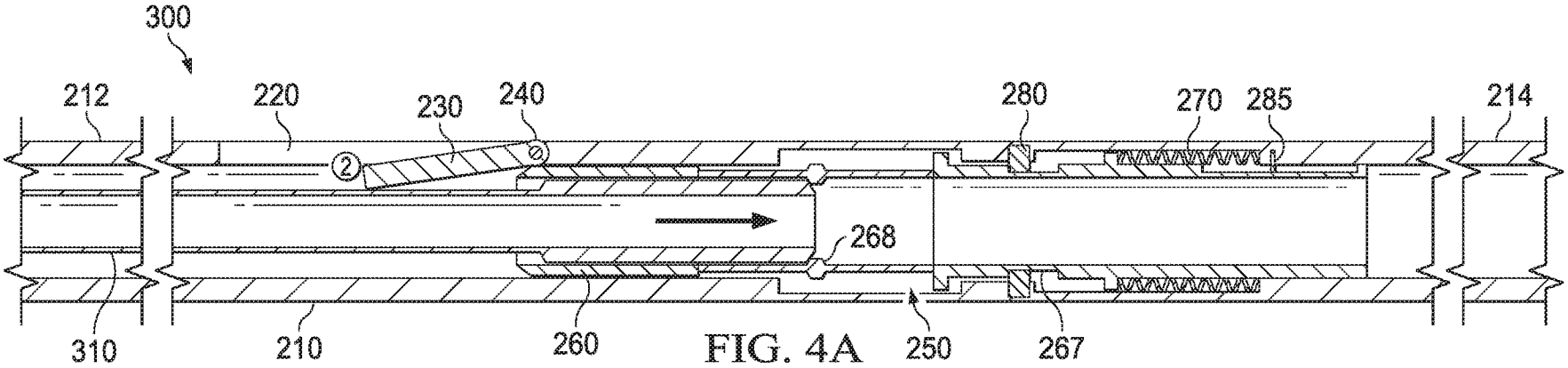
Figure 4B:
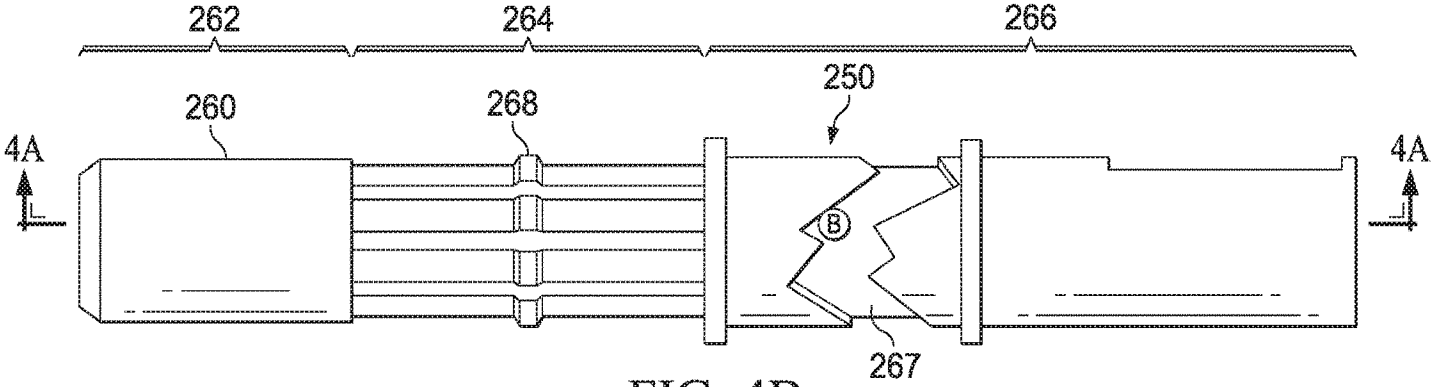

Turning to FIGS. 4A and 4B, as the downhole tool 310 slides further downhole, a profile of the downhole tool 310 engages with the shifting profile 268 of the collet section 264, thereby causing the inner sleeve 260 to linearly shift downhole. The continued linear downhole shifting of the inner sleeve 260 causes the protrusion 282 in the cycle ring 280 to rotate within the slot 267 in the inner sleeve 260. The inner sleeve 260 continues to linearly shift downhole until the protrusion 282 in the cycle ring 280 engages position (Ⓑ) in the slot 267, which stops any further downhole linear shifting of the inner sleeve 260. At this moment, the protrusion 282 in the cycle ring 280 is engaged with position (Ⓑ) in the slot 267, which in turn positions the inner sleeve 260 in a manner such that the deflector ramp 230 is in the second (②) partially closed position.

Figure 5A:
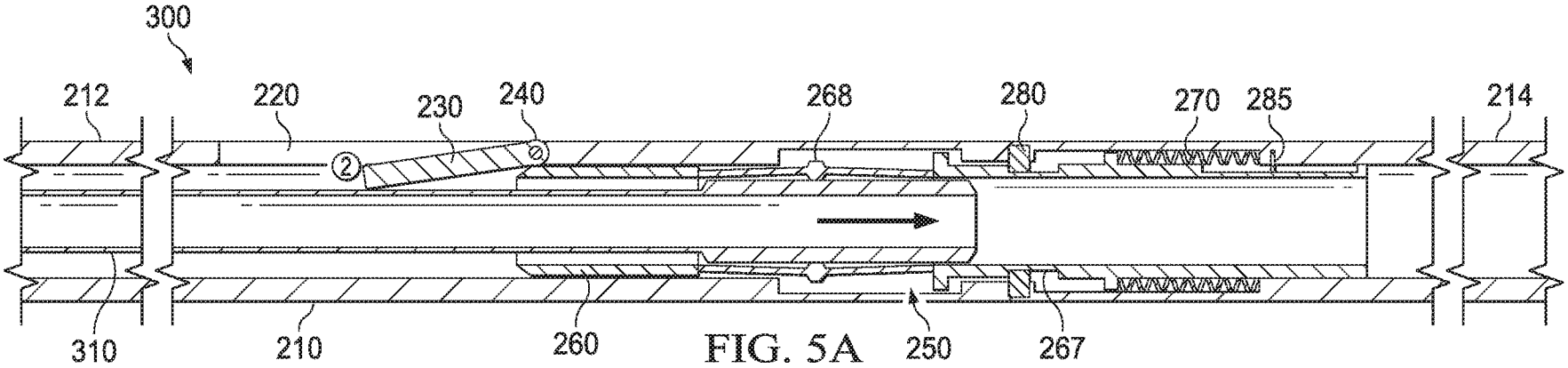
Figure 5B:
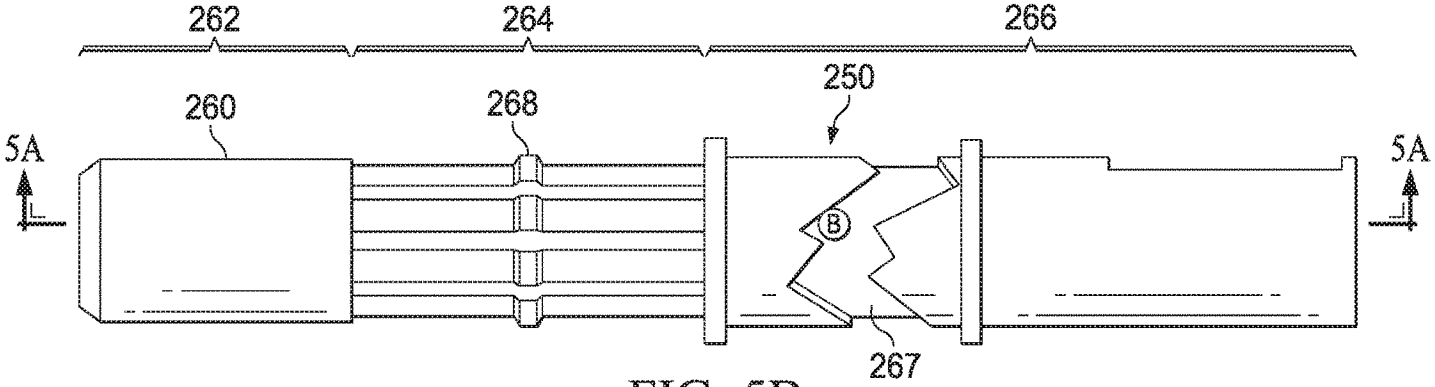

Turning to FIGS. 5A and 5B, as the downhole tool 310 slides further downhole a slot in the deflector body 210 allows the collect section 264 in the inner sleeve 260 to flex radially outward. Accordingly, the profile in the downhole tool 310 is allowed to continue past the shifting profile 268 in the inner sleeve 260. At this moment, the protrusion 282 in the cycle ring 280 is still engaged with position (Ⓑ) in the slot 267, which in turn still positions the inner sleeve 260 in a manner such that the deflector ramp 230 is in the second (②) partially closed position.

Figure 6A:
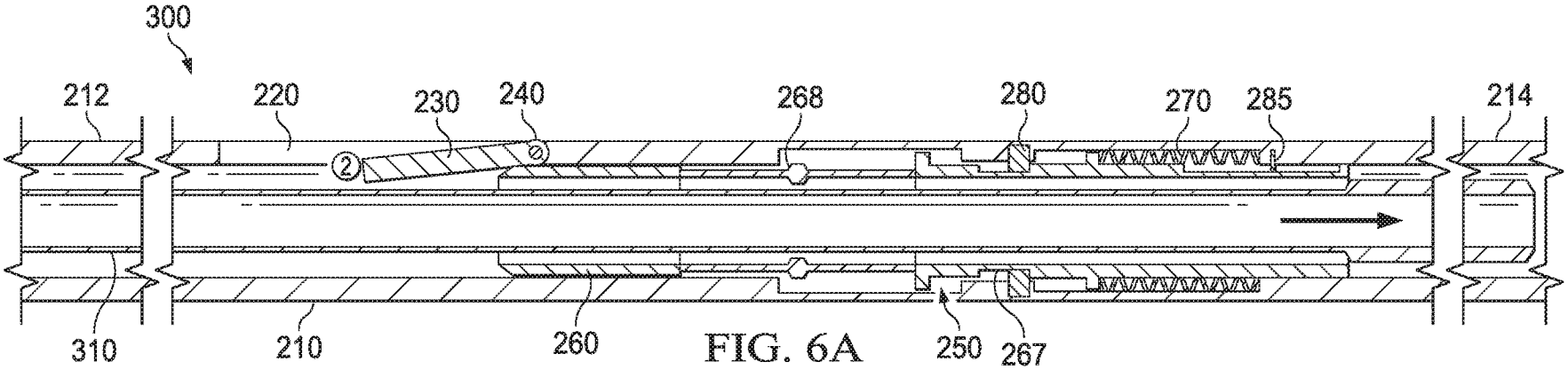
Figure 6B:
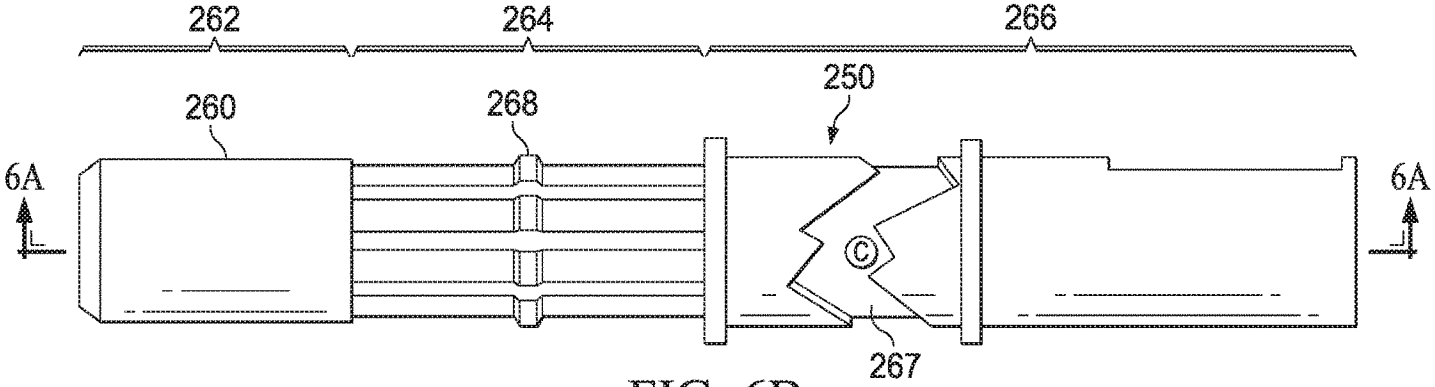

Turning to FIGS. 6A and 6B, as the downhole tool 310 slides further downhole the profile of the downhole tool 310 fully passes the shifting profile 268 in the inner sleeve 260, thereby allowing the collet section 264 of the inner sleeve 260 to return to its original un-flexed position. At this moment, the inner sleeve spring 270 is allowed to linearly shift the inner sleeve 260 back toward the deflector ramp 230. Accordingly, the linear uphole shifting of the inner sleeve 260 causes the protrusion 282 in the cycle ring 280 to rotate within the slot 267 in the inner sleeve 260. The inner sleeve 260 continues to linearly shift toward the deflector ramp 230 until the protrusion 282 in the cycle ring 280 engages position (Ⓒ) in the slot 267, which stops any further uphole linear shifting of the inner sleeve 260. At this moment, the protrusion 282 in the cycle ring 280 is engaged with position (Ⓒ) in the slot 267, which in turn positions the inner sleeve 260 in a manner such that the deflector ramp 230 is in the second (②) partially closed position. The downhole tool 310 may continue downhole past the deflector assembly 300 to perform one or more tasks within the main wellbore downhole of the deflector assembly 300.

Figure 7A:
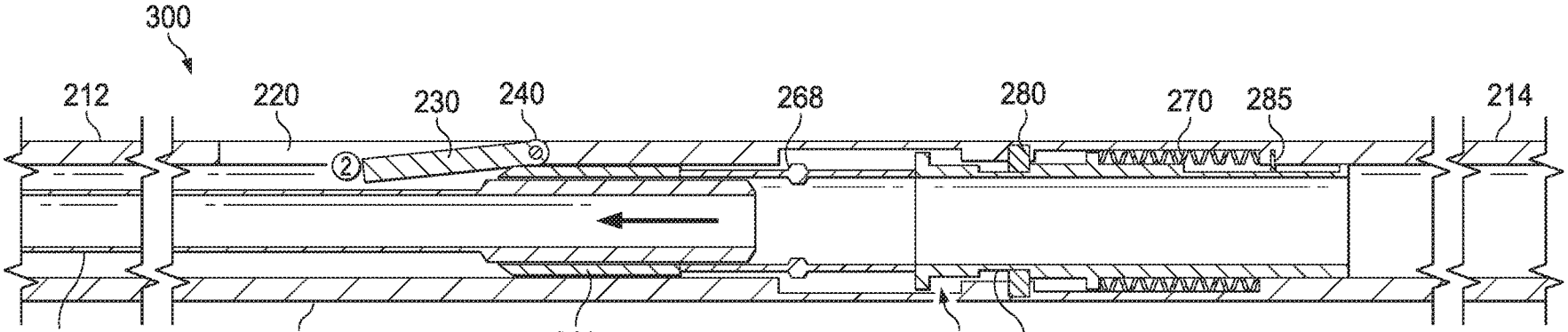
Figure 7B:
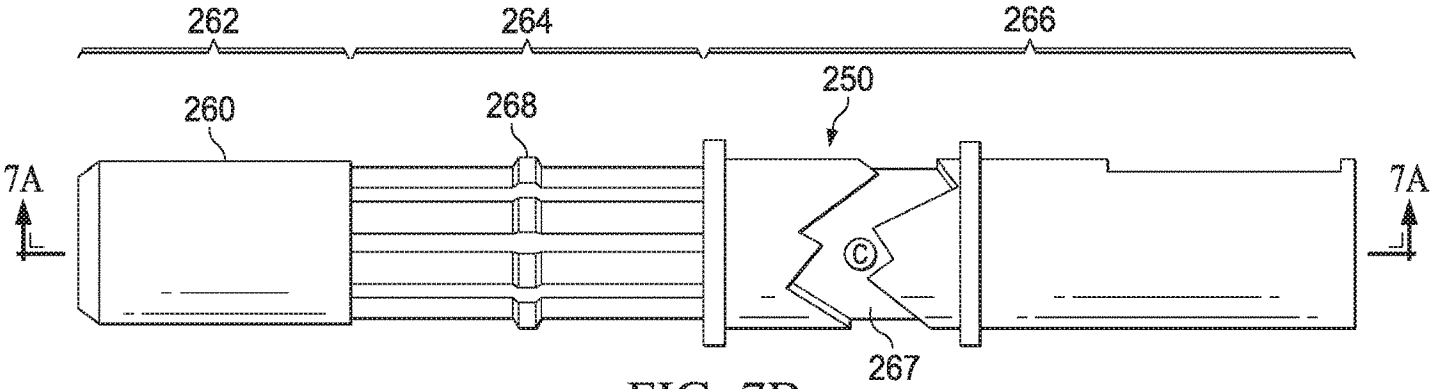

Turning to FIGS. 7A and 7B, after the downhole tool 310 has performed one or more tasks within the main wellbore downhole of the deflector assembly 300, the downhole tool 310 may be withdrawn uphole toward the deflector assembly 300. With the protrusion 282 in the cycle ring 280 engaged in position (Ⓒ) in the slot 267, the shifting profile 268 is positioned radially inside of the slot in the deflector body 210. Accordingly, as the profile on the downhole tool 310 approaches the shifting profile 268, the collect section 264 in the inner sleeve 260 is again allowed to flex radially outward so that the downhole tool 310 may slide there past. At this moment, the protrusion 282 in the cycle ring 280 is engaged with position (Ⓒ) in the slot 267, which in turn positions the inner sleeve 260 in a manner such that the deflector ramp 230 is in the second (②) partially closed position.

Figure 8A:
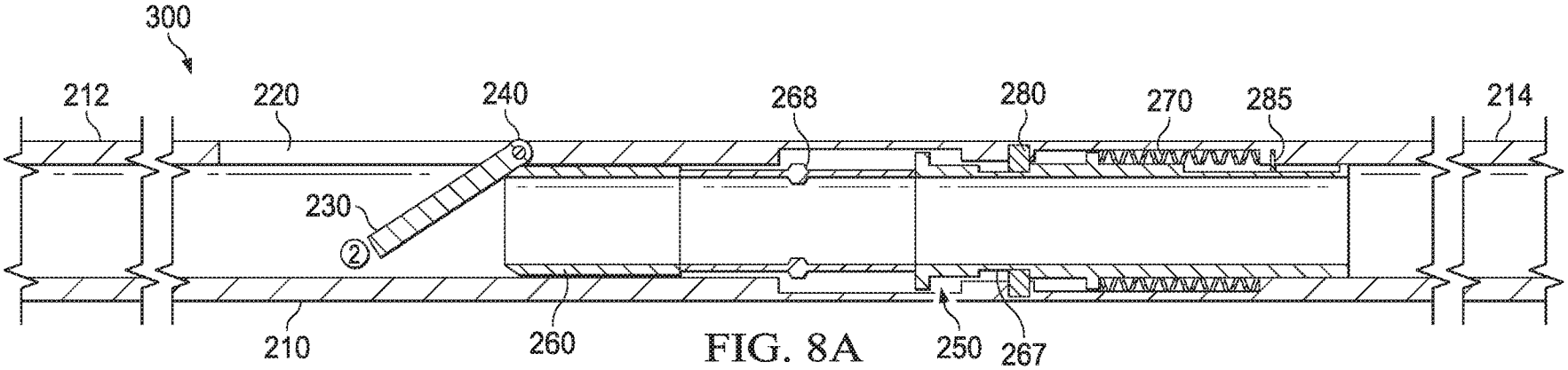
Figure 8B:
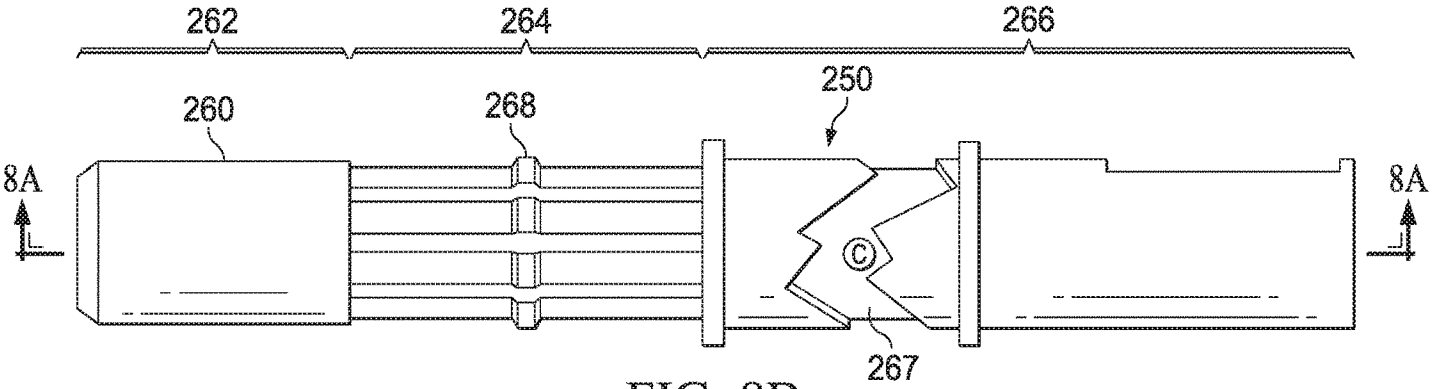

Turning to FIGS. 8A and 8B, the downhole tool 310 may be withdrawn entirely uphole of the deflector assembly 300. In certain embodiments, the downhole tool 310 is withdrawn out of the wellbore, and thereafter a similar and/or different downhole tool 310 is positioned back within the wellbore. In other embodiments, the downhole tool 310 is just withdrawn uphole of the deflector ramp 230. At this moment, the protrusion 282 in the cycle ring 280 is engaged with position (Ⓒ) in the slot 267, which in turn positions the inner sleeve 260 in a manner such that the deflector ramp 230 is in the second (②) partially closed position. As the downhole tool 310 is no longer positioned within the deflector assembly 300, the deflector ramp 230 no longer rests upon the downhole tool 310, and thus may fully move to the second (②) partially closed position.

Figure 9A:
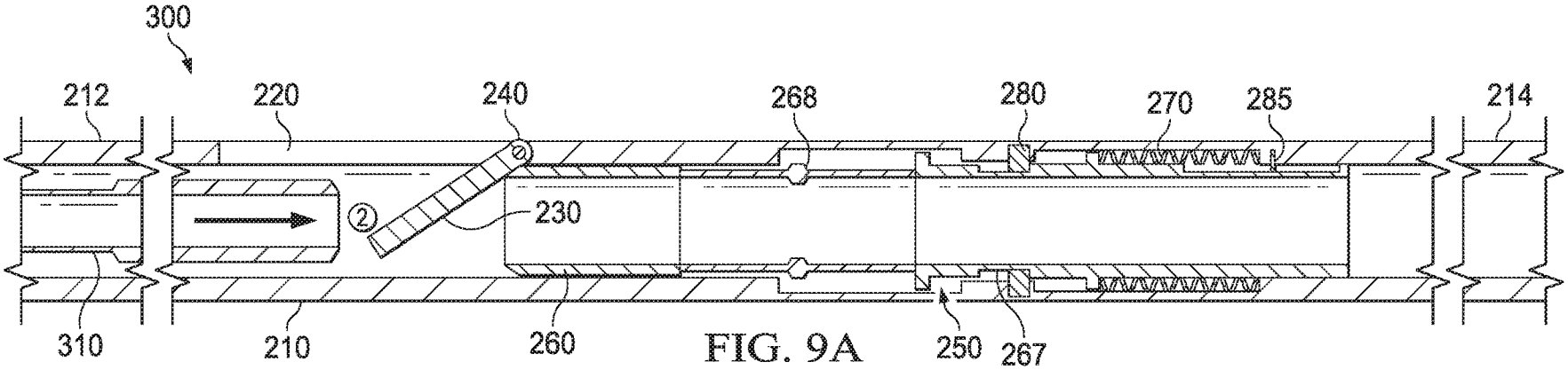
Figure 9B:
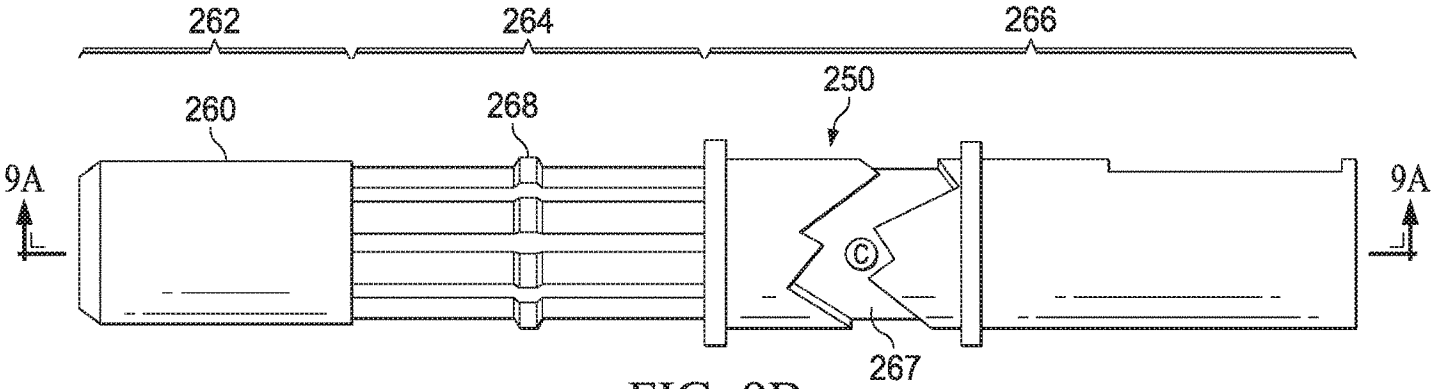

Turning to FIGS. 9A and 9B, as the downhole tool 310 slides back downhole, it approaches the deflector ramp 230. At this moment, the protrusion 282 in the cycle ring 280 is engaged with position (Ⓒ) in the slot 267, which in turn positions the inner sleeve 260 in a manner such that the deflector ramp 230 is in the second (②) partially closed position. As is evident, the downhole tool 310 may not continue linearly downhole without encountering the deflector ramp 230.

Figure 10A:
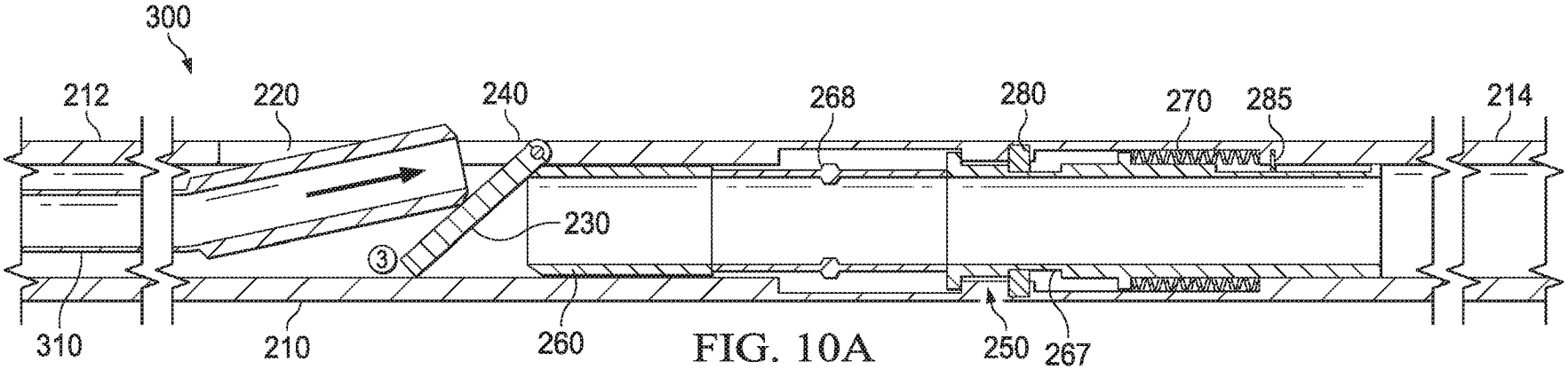
Figure 10B:
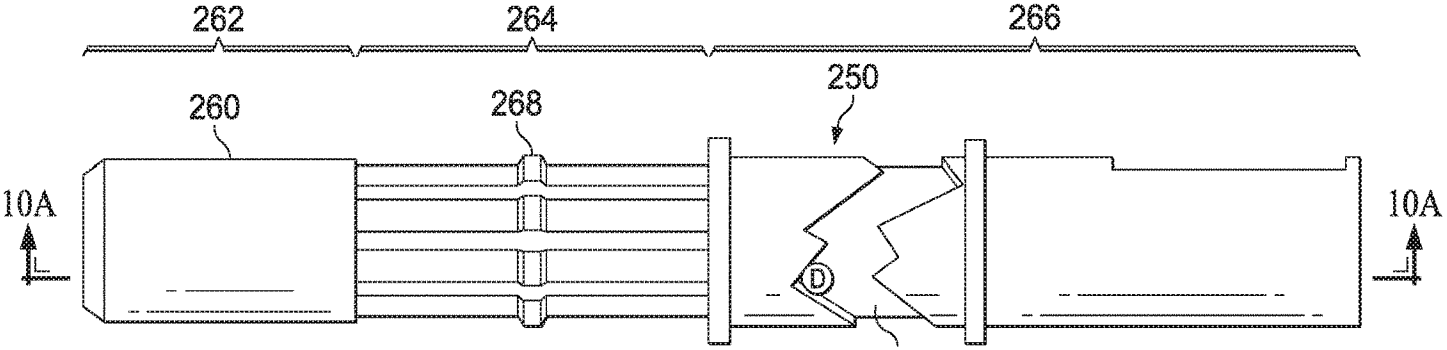

Turning to FIGS. 10A and 10B, as the downhole tool 310 slides further downhole, the downhole tool 310 engages with the deflector ramp 230. Accordingly, the downhole tool 310 pushes the deflector ramp 230 from the second (②) partially closed position to the third (③) fully closed position. As the downhole tool 310 continues linearly downhole, the deflector ramp 230 redirects the downhole tool 310 into the lateral wellbore. Furthermore, as the deflector ramp 230 moves from the second (②) partially closed position to the third (③) fully closed position, the deflector ramp 230 linearly shifts the inner sleeve 260 downhole. The inner sleeve 260 continues to linearly shift downhole until the protrusion 282 in the cycle ring 280 engages position (Ⓓ) in the slot 267, which stops any further downhole linear shifting of the inner sleeve 260. At this moment, the protrusion 282 in the cycle ring 280 is engaged with position (Ⓓ) in the slot 267, which in turn positions the inner sleeve 260 in a manner such that the deflector ramp 230 is in the third (③) fully closed position. The downhole tool 310 may continue within the lateral wellbore to perform one or more tasks therein.

Figure 11A:
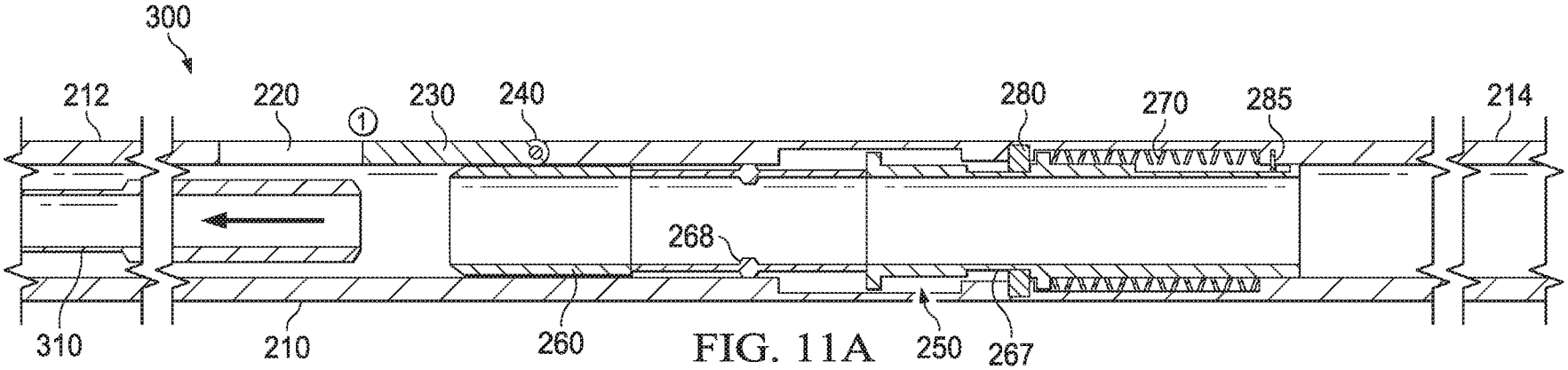
Figure 11B:
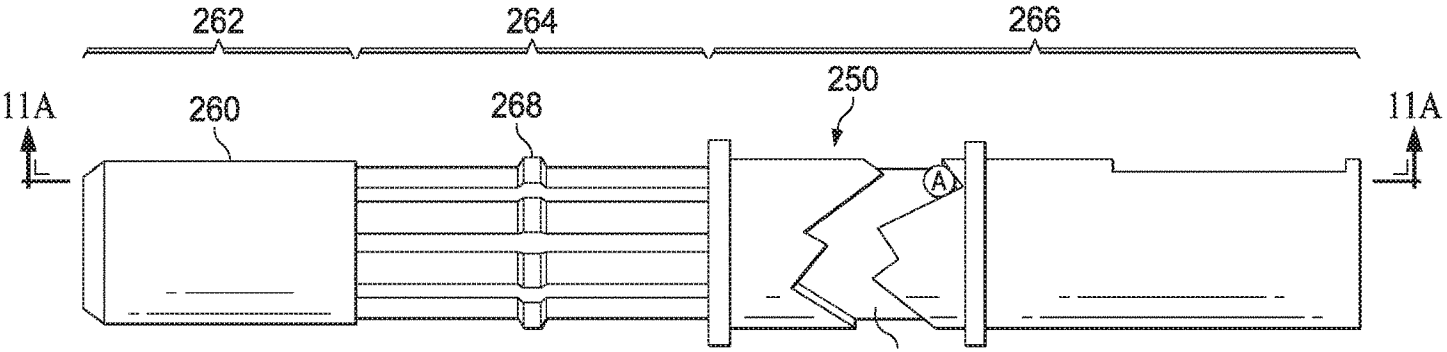

Turning finally to FIGS. 11A and 11B, the downhole tool 310 is withdrawn back uphole and out of the lateral wellbore. As the downhole tool 310 is withdrawn out of the lateral wellbore, the inner sleeve spring 270 pushes the inner sleeve 260 back toward the deflector ramp 230. At this moment, the protrusion 282 in the cycle ring 280 is once again engaged with position (Ⓐ) in the slot 267, which in turn positions the inner sleeve 260 in a manner such that the deflector ramp 230 is in the first open (①) position. The process of cycling the downhole ramp 230 between the first open (①) position, second (②) partially closed position, and third (③) fully closed position may continue as many times as is necessary.

Figure 12:
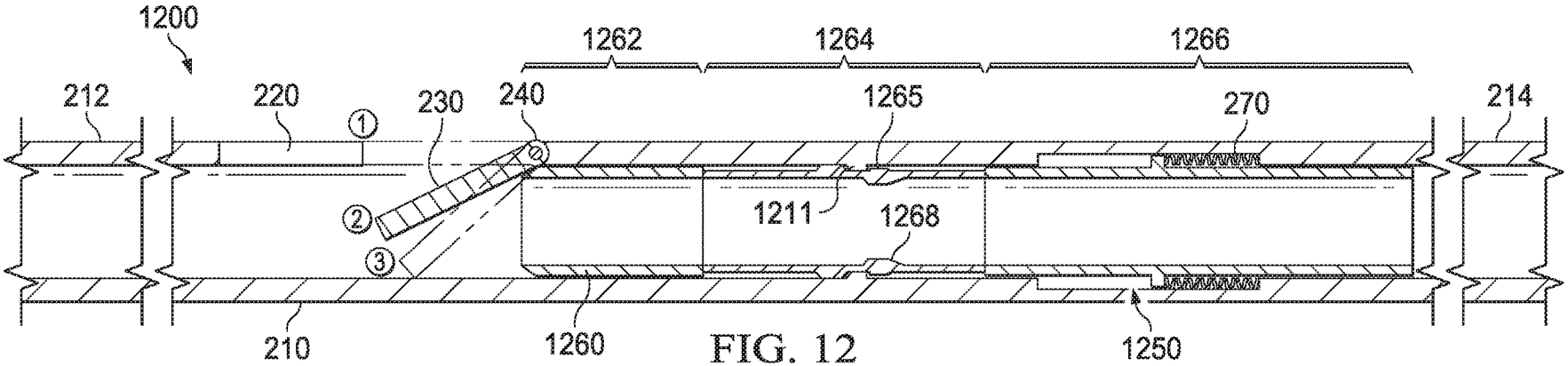
FIG. 12 illustrates a deflector assembly designed, manufactured and operated according to another embodiment of the disclosure.

Turning to FIG. 12, illustrated is a deflector assembly 1200 designed, manufactured and operated according to another embodiment of the disclosure. The deflector assembly 1200 is similar in many respects to the deflector assembly 200 discussed above. Accordingly, like reference numbers have been used to represent similar, if not identical, features. The deflector assembly 1200 differs, for the most part, from the deflector assembly 200 in that the actuation member 1250 of the deflector assembly 1200 differs from the actuation member 250 of the deflector assembly 200. For instance, wherein the actuation member 250 employs the slot 267 in the inner sleeve 260 to determine a position of the inner sleeve 260, and thus the deflector ramp 230, the actuation member 1250 does not employ the slot 267, but employs a locking feature 1265 in a collet section 1264 of the inner sleeve 1260 to determine a position of the inner sleeve 1260, and thus the deflector ramp 230. The locking feature 1265, in one embodiment, extends from an outer surface of the collet section 1264 of the inner sleeve 1260, and is operable to engage/disengage with a profile 1211 in the deflector body 210.

The deflector assembly 1200, in the illustrated embodiment of FIG. 12, has an actuation member 1250 configured to move the deflector ramp 230 (e.g., between the first (①), second (②) and third (③) illustrated positions). The actuation member 1250, in one embodiment, includes the inner sleeve 1260 that slides along an interior surface of the deflector body 210. The inner sleeve 1260, in accordance with one embodiment of the disclosure, includes an uphole section 1262, the collet section 1264 (e.g., which may flex radially inward and radially outward, and includes the shifting profile 1268 and the locking feature 1265), and a downhole section 1266.

Accordingly, the inner sleeve 1260 is used to control the position of the deflector ramp 230 (e.g., between the first (①), second (②) and third (③) illustrated positions). When the inner sleeve 1260 is in a first position, it props the deflector ramp 230 in the first (①) open position. When a downhole tool passes through the deflector assembly 1200, the inner sleeve 1260 is shifted away from the deflector ramp 230. In this moment, the locking profile 1265 latches the inner sleeve 1260 in place, thus allowing the deflector ramp 230 to remain in the second (②) partially closed position. A recess in the deflector body 210 allows the collet section 1264 to flex up allowing the downhole tool to pass through the deflector assembly 1200. In this position, the deflector ramp 230 wants to close but is unable to close until the downhole tool is withdrawn uphole of the deflector ramp 230. Once the downhole tool is withdrawn uphole of the deflector ramp 230, the deflector ramp 230 fully moves to the second (②) partially closed position.

With the deflector ramp 230 in the second (②) partially closed position, any downhole tool approaching the deflector ramp 230 will push the deflector ramp 230 to the third (③) fully closed position and deflect off the deflector ramp 230 and into the lateral wellbore. The action of pushing the deflector ramp 230 to the third (③) fully closed position shifts the inner sleeve 1260 to the right, thereby unlatching the locking profile 1265 from the deflector body 210. Once the downhole tool is pulled out of the lateral, the inner sleeve 1260 is allowed to push the deflector ramp 230 back to the first (①) open position. The cycle may then start over.

Figure 13A:
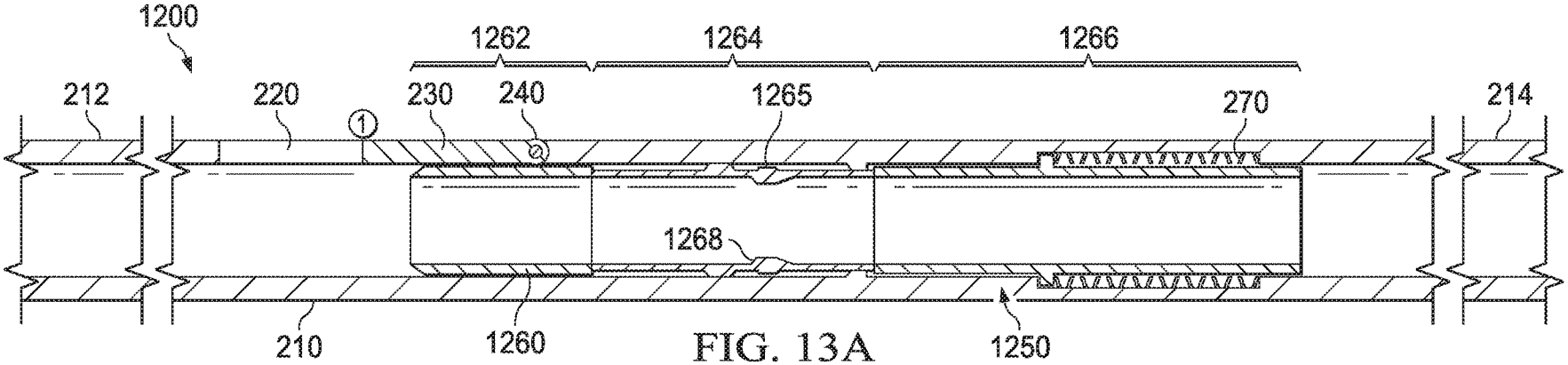
FIGS. 13A-13C illustrate the deflector assembly illustrated in FIG. 12 with the deflector ramp at each of the first (①), second (②) and third (③) positions.
Figure 13B:
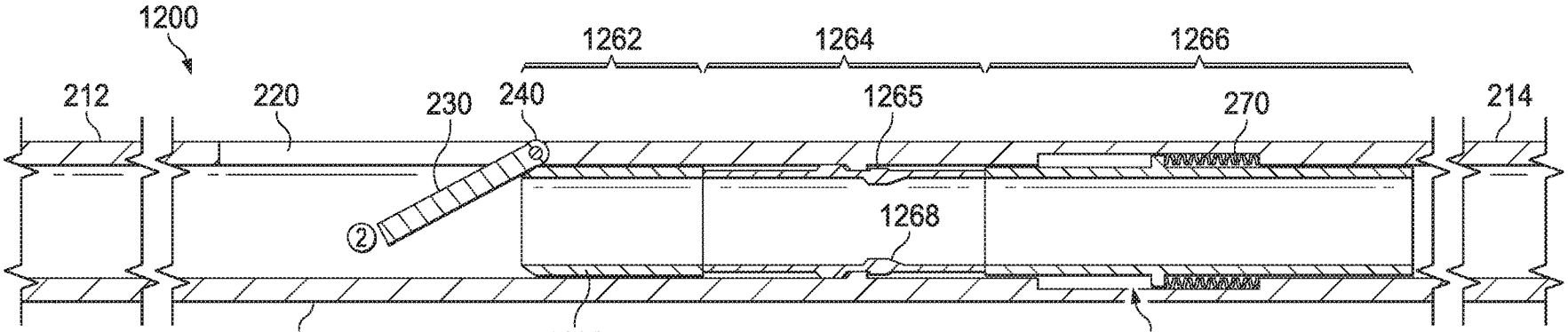
Figure 13C:
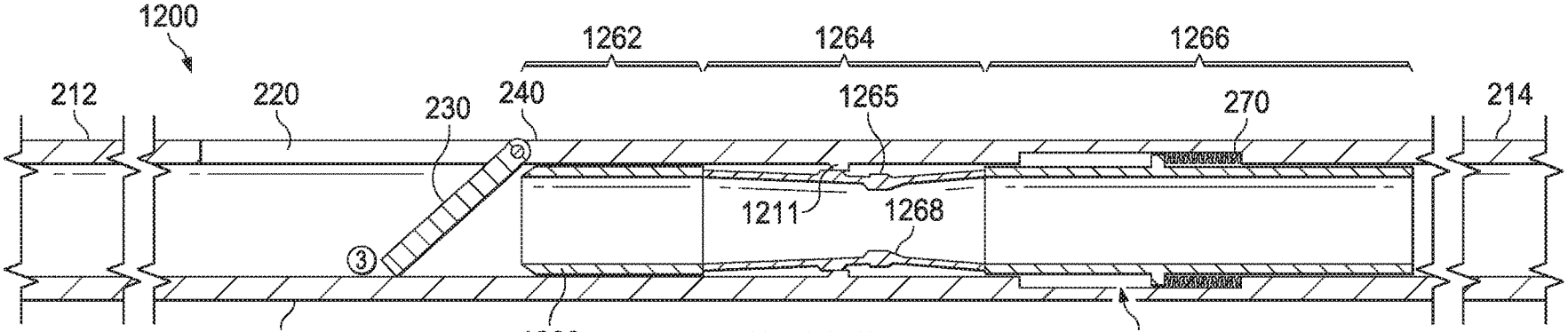

Turning briefly to FIGS. 13A-13C, illustrated is the deflector assembly 1200 illustrated in FIG. 12 with the deflector ramp 230 at each of the first (①), second (②) and third (③) positions. Given the foregoing, one skilled in the art would understand the actuations necessary to move the deflector ramp 230 between each of the first (①), second (②) and third (③) positions.

Figure 14:
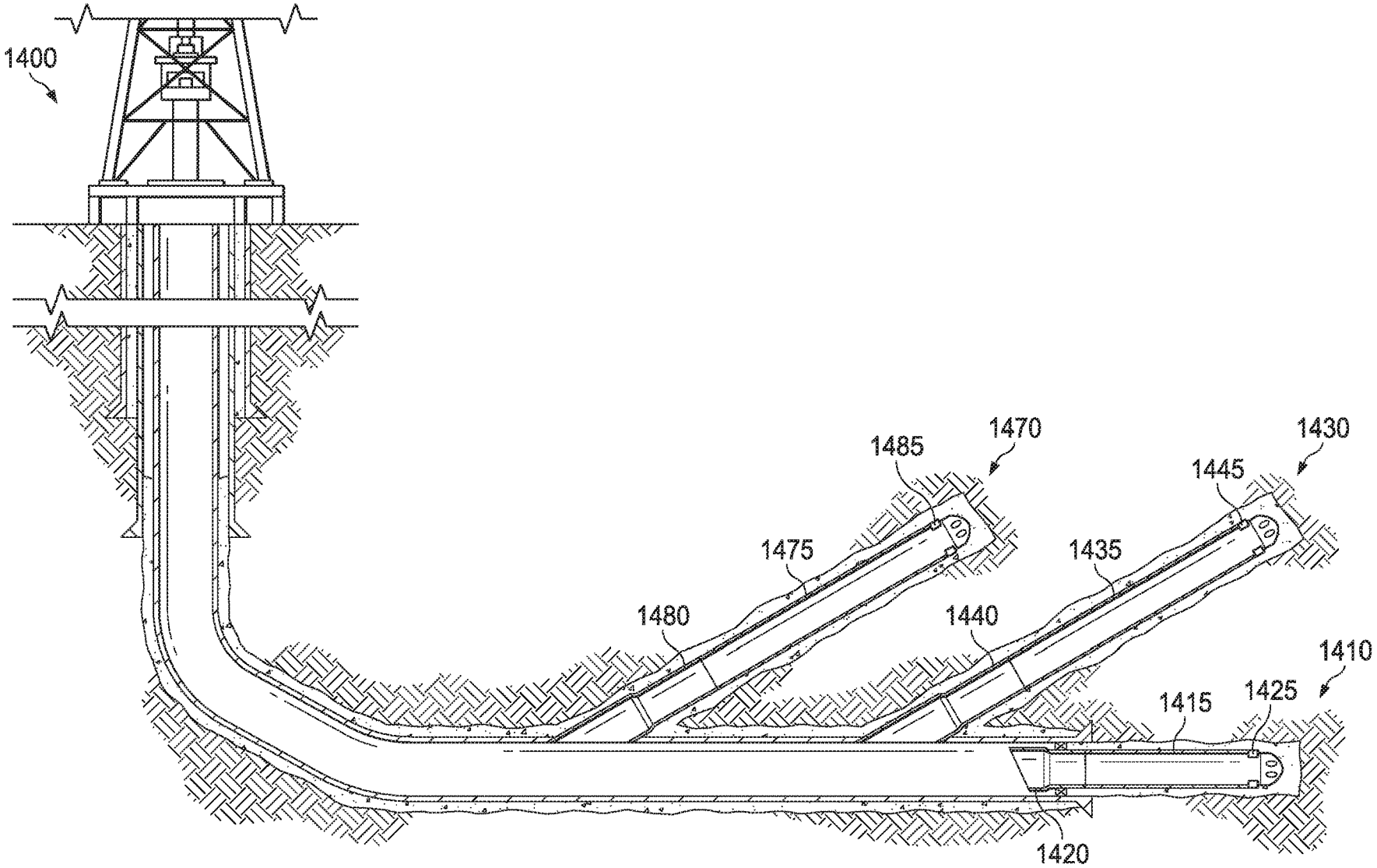
FIGS. 14 through 36 illustrate one methodology for drilling a multilateral well according to the disclosure.

Turning to FIGS. 14 through 36, illustrated is one methodology for drilling a multilateral well 1400 according to the disclosure. The multilateral well 1400 illustrated in the embodiment of FIG. 14 includes a main wellbore section 1410, a lower lateral wellbore section 1430, and an upper lateral wellbore section 1470. It should be noted that while one main wellbore section 1410, and two lateral wellbore sections 1430, 1470 are illustrated in FIG. 14, other embodiments may exist where more or less than two lateral wellbore sections 1430, 1470 are employed. Accordingly, the present disclosure should not be limited to any specific number of lateral wellbore sections. Moreover, even though the lateral wellbore sections 1430, 1470 are illustrated as level 4 junctions, the present disclosure is equally applicable to level 2 and level 3 junctions.

In the illustrated embodiment of FIG. 14, a main wellbore liner 1415, for example having an anchor hanger 1420 and toe sub 1425, is positioned (e.g., cemented in one embodiment) within the main wellbore section 1410. Furthermore, a lower lateral wellbore liner 1435, for example having a lower lateral receptacle and seal bore 1440 and lower toe sub 1445, is positioned (e.g., cemented in one embodiment) within the lower lateral wellbore section 1430. Additionally, an upper lateral wellbore liner 1475, for example having an upper lateral receptacle and seal bore 1480 and upper toe sub 1485, is positioned (e.g., cemented in one embodiment) within the upper lateral wellbore section 1470. Those skilled in the art understand the steps necessary to achieve the multilateral well 1400 illustrated in FIG. 14, thus no further detail is given.

Figure 15:
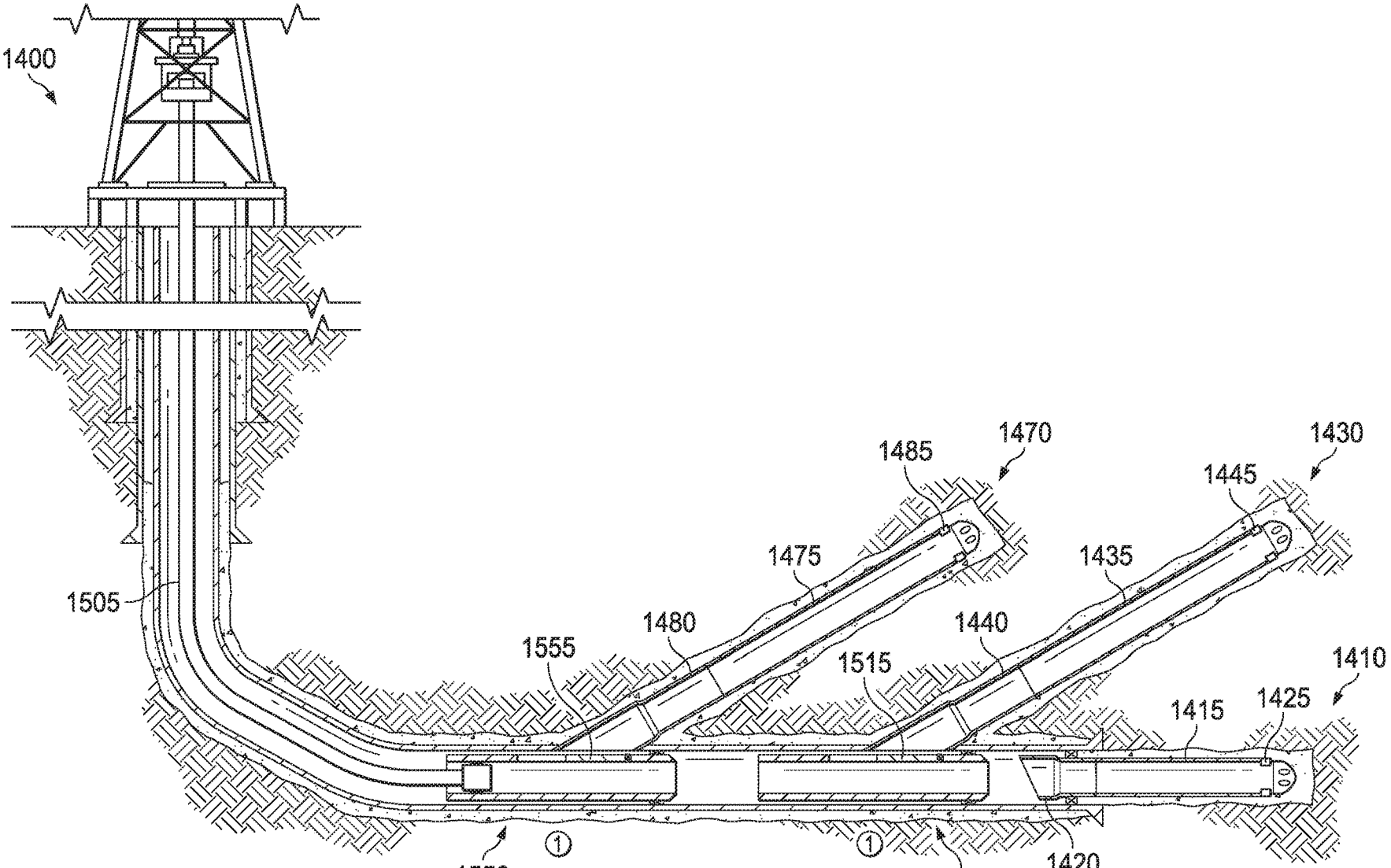

Turning to FIG. 15, illustrated is the multilateral well 1400 of FIG. 14 after installing a lower lateral deflector assembly 1510 and an upper lateral deflector assembly 1550 at junctions between the main wellbore section 1410 and the lower lateral wellbore section 1430 and upper lateral wellbore section 1470, respectively. In one embodiment, the lower lateral deflector assembly 1510 and the upper later deflector assembly 1550 are installed using a conveyance 1505, such as workstring or pipe, among other conveyances. The lower lateral deflector assembly 1510 and the upper later deflector assembly 1550 may be similar to the deflector assemblies 200, 1200 discussed above, among other deflector assemblies designed, manufactured and operated according to the disclosure. Deflector ramps 1515, 1555, on each of the lower lateral deflector assembly 1510 and the upper later deflector assembly 1550, respectively, are positioned in the first (①) open positions while the lower lateral deflector assembly 1510 and the upper later deflector assembly 1550 are run-in-hole.

Figure 16:
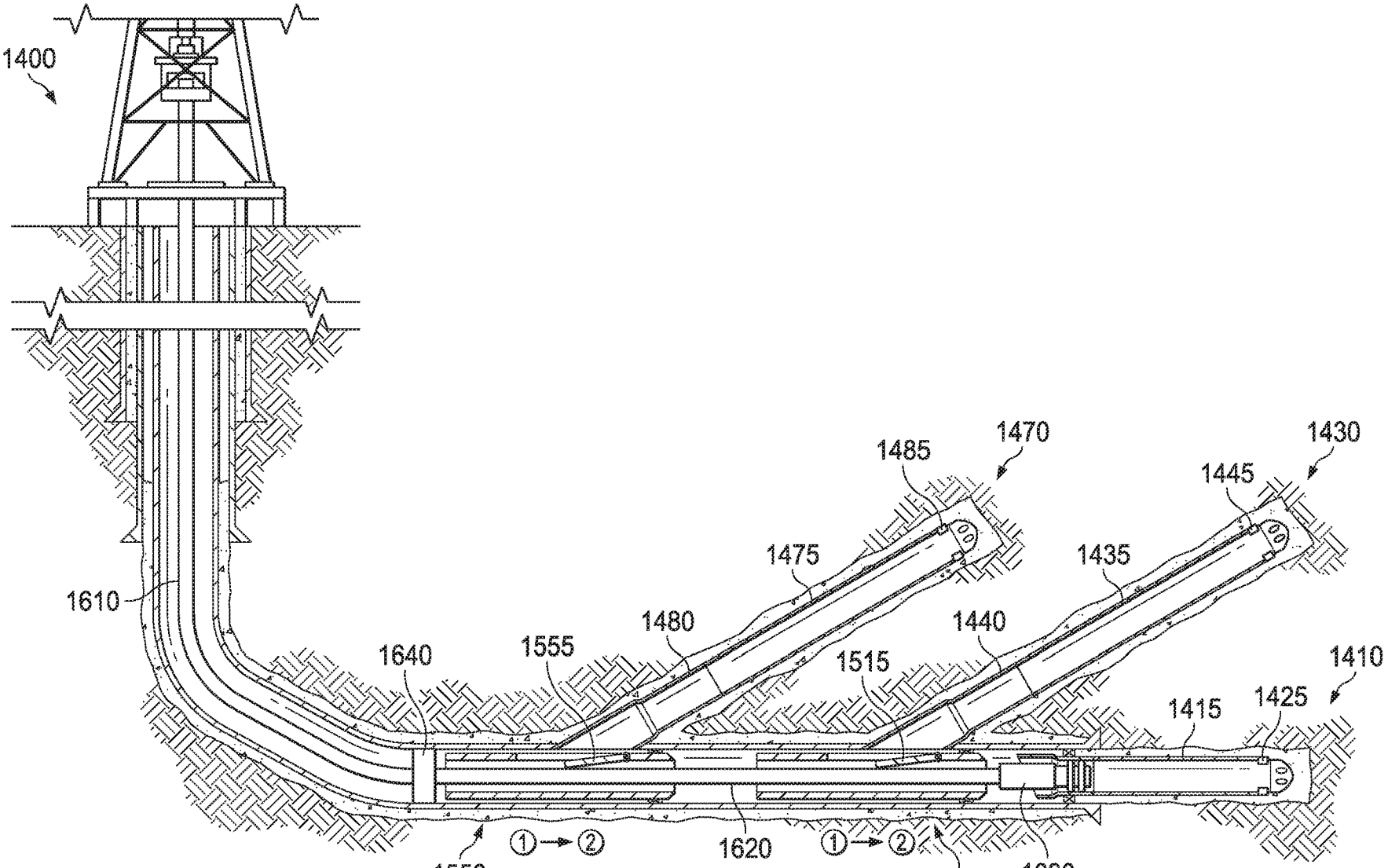

Turning to FIG. 16, illustrated is the multilateral well 1400 of FIG. 15 after running a downhole tool 1610 to the main wellbore section 1410. The downhole tool 1610, in the illustrated embodiment, includes a junction isolation tool 1620 having a shrouded seal assembly 1630 and a cup packer with hold down 1640. In the illustrated embodiment of FIG. 16, the shrouded seal assembly 1630 engages with a seal bore of the main wellbore liner 1415. In accordance with one embodiment of the disclosure, as the downhole tool 1610 passes each of the deflector ramps 1515, 1555, they are triggered from the first (①) open position to the second (②) partially closed position. Since the junction isolation tool 1620 remains within each of the lower lateral deflector assembly 1510 and the upper later deflector assembly 1550, the deflector ramps 1515, 1555, are propped up by the junction isolation tool 1620, and thus do not fully rotate to the second (②) partially closed position.

Figure 17:
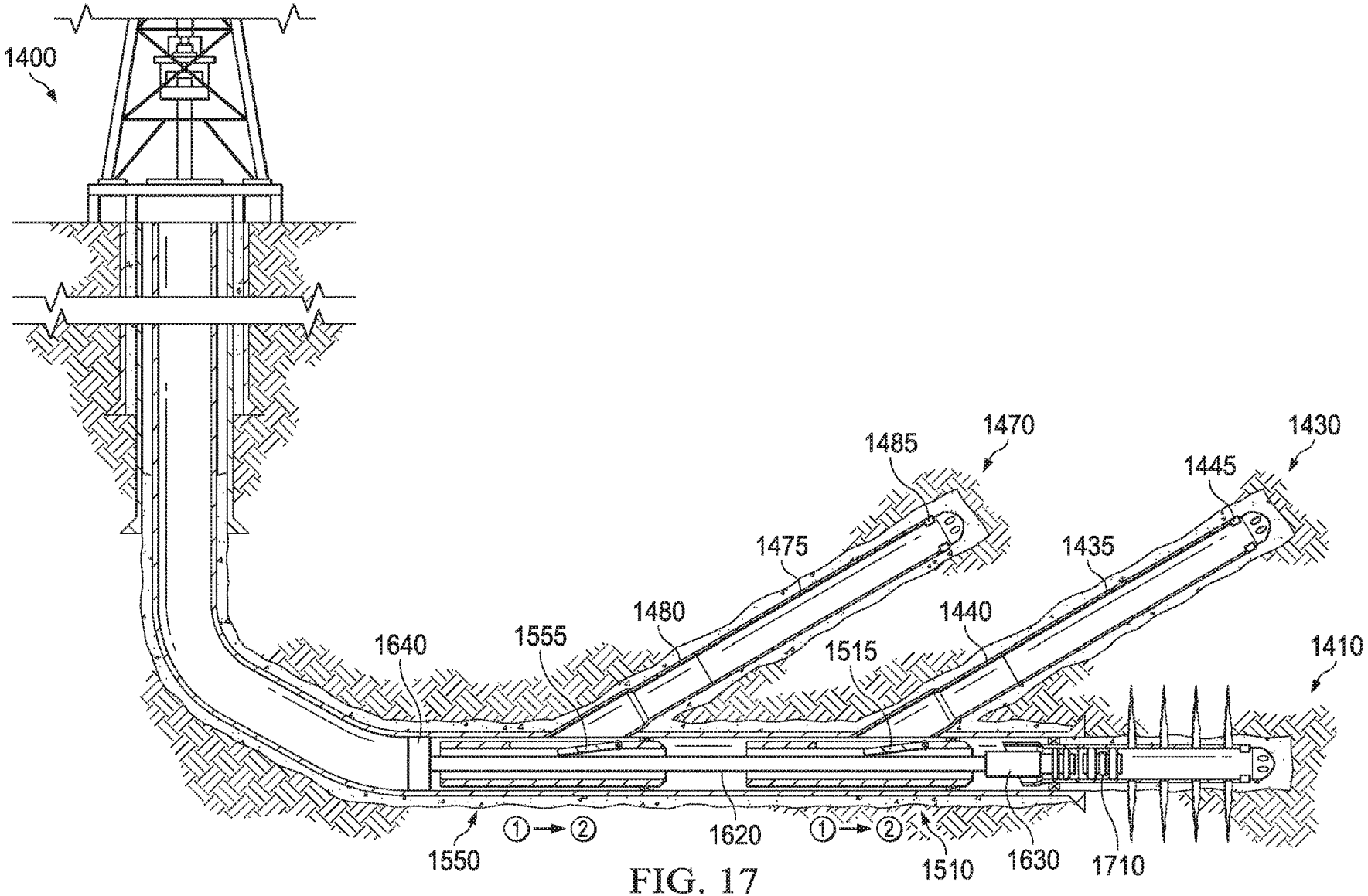

Turning to FIG. 17, illustrated is the multilateral well 1400 of FIG. 16 after disconnecting from the junction isolation tool 1620 and then fracturing the main wellbore section 1410. Those skilled in the art appreciate the steps necessary to fracture the main wellbore section 1410. After fracturing the main wellbore section 1410, a main wellbore barrier plug 1710 may be placed therein. At this stage, each of the of the deflector ramps 1515, 1555, remain triggered from the first (①) open position toward the second (②) partially closed position.

Figure 18:
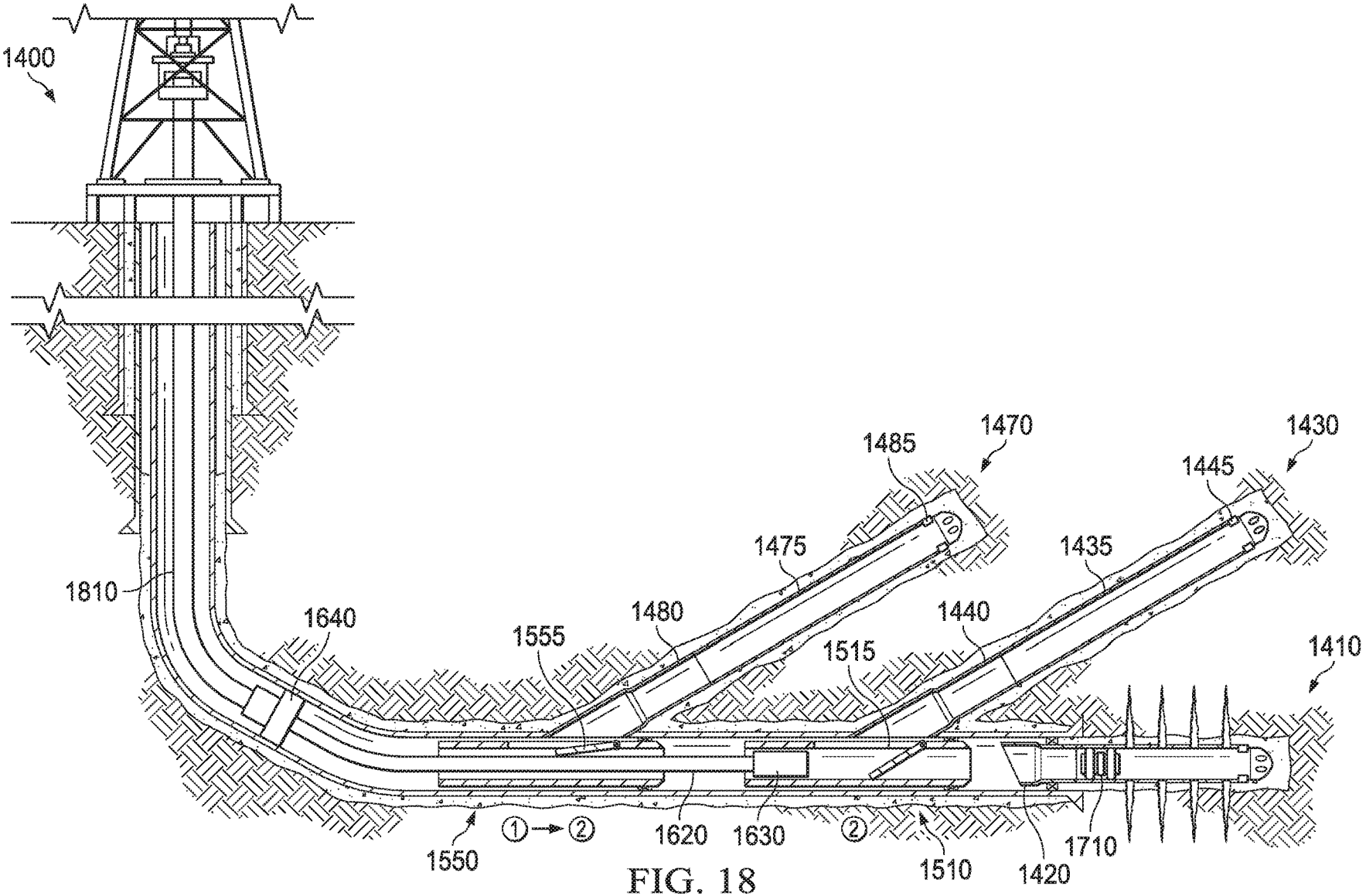

Turning to FIG. 18, illustrated is the multilateral well 1400 of FIG. 17 after attaching a downhole tool 1810 to the junction isolation tool 1620, and then withdrawing the junction isolation tool 1620 from the main wellbore section 1410 and just uphole of the deflector ramp 1515 in the lower lateral deflector assembly 1510. In accordance with one embodiment of the disclosure, as the junction isolation tool 1620 passes uphole of the deflector ramp 1515, the deflector ramp 1515 is no longer propped up by the junction isolation tool 1620 and thus rotates fully to the second (②) partially closed position. At this stage, the deflector ramp 1515 is located at the second (②) partially closed position, and the deflector ramp 1555 remains triggered from the first (①) open position toward the second (②) partially closed position.

Figure 19:
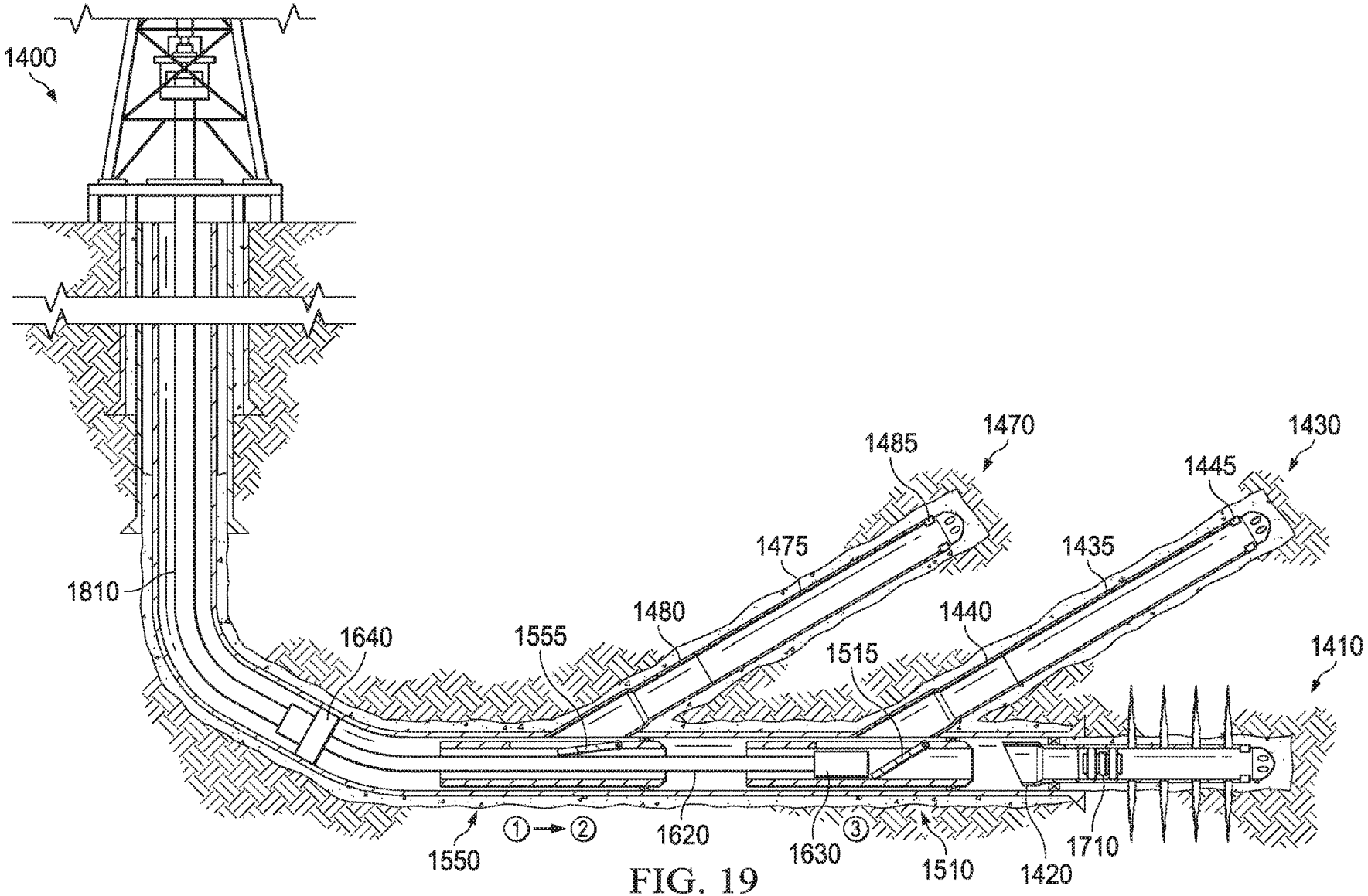

Turning to FIG. 19, illustrated is the multilateral well 1400 of FIG. 18 after pushing the downhole tool 1810 and junction isolation tool 1620 downhole until such time as the junction isolation tool 1620 engages the deflector ramp 1515. Continued pushing of the downhole tool 1810 and junction isolation tool 1620 causes the junction isolation tool 1620 to move the deflector ramp 1515 to the third (③) fully closed position, while the deflector ramp 1555 remains triggered from the first (①) open position toward the second (②) partially closed position.

Figure 20:
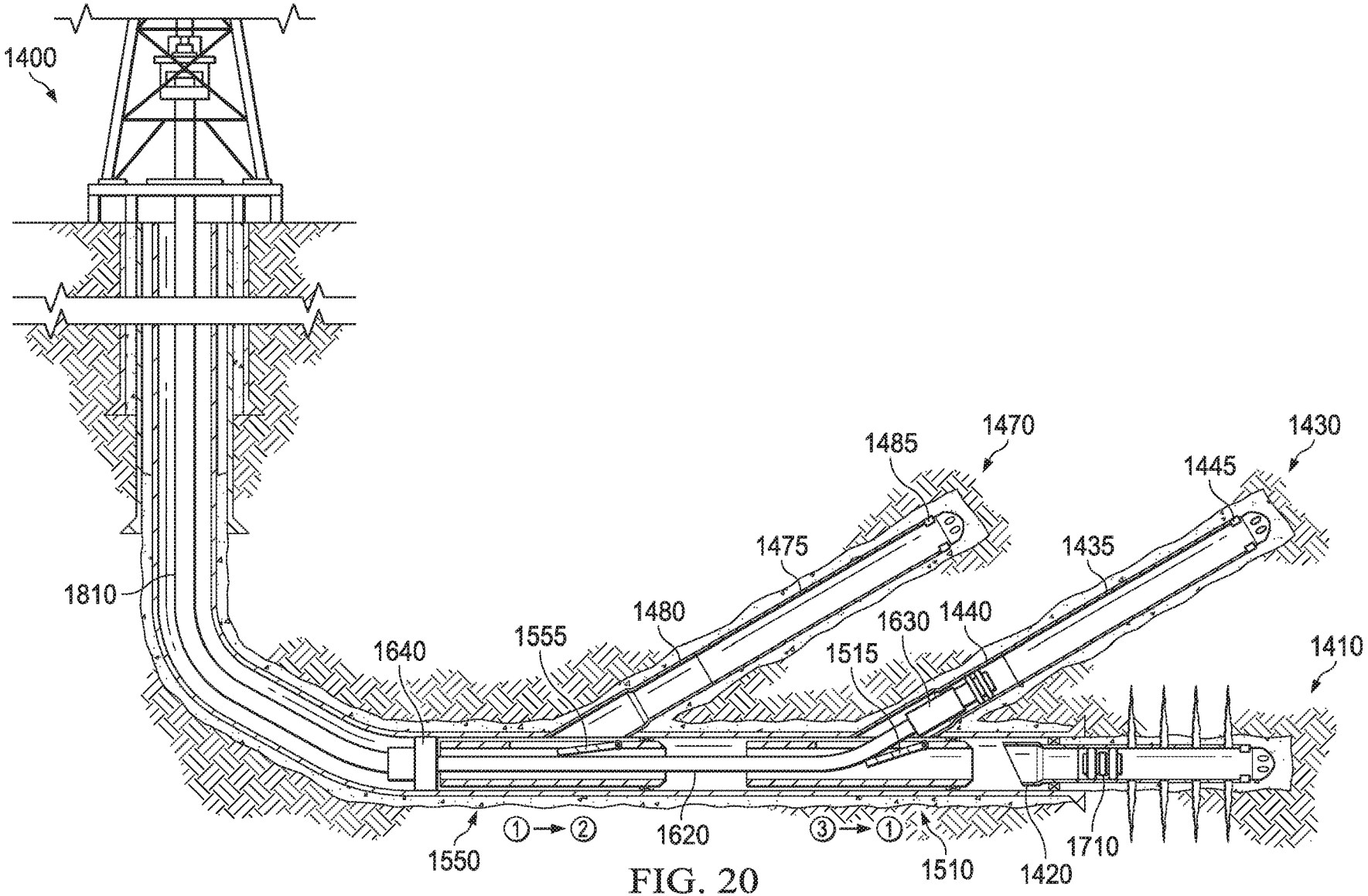

Turning to FIG. 20, illustrated is the multilateral well 1400 of FIG. 19 after continuing pushing the downhole tool 1810 and junction isolation tool 1620 downhole until such time the junction isolation tool 1620 exits the main wellbore section 1410 and enters the lower lateral wellbore section 1430. In the illustrated embodiment of FIG. 20, the shrouded seal assembly 1630 engages with the lower lateral receptacle and seal bore 1440. At this stage, the deflector ramp 1515 is triggered from the third (③) fully closed position toward the first (①) open position, while the deflector ramp 1555 remains triggered from the first (①) open position toward the second (②) partially closed position. As the junction isolation tool 1620 remains within the lower lateral wellbore section 1430, the deflector ramp 1515 cannot rotate to the first (①) open position. At this stage, the deflector ramp 1515 is triggered from the third (③) fully closed position to the first (①) open position, while the deflector ramp 1555 remains triggered from the first (①) open position toward the second (②) partially closed position.

Figure 21:
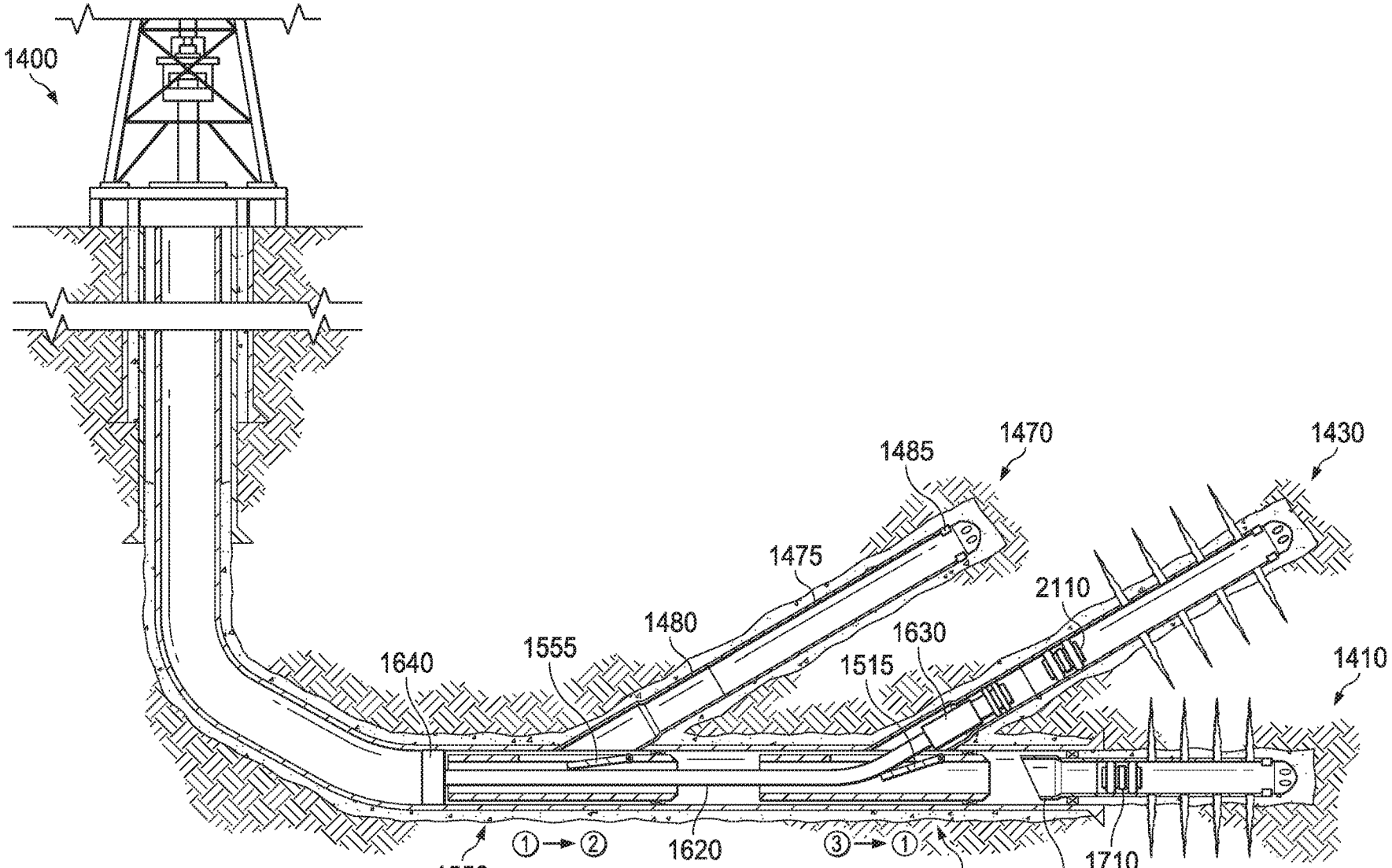

Turning to FIG. 21, illustrated is the multilateral well 1400 of FIG. 20 after disconnecting from the junction isolation tool 1620 and then fracturing the lower lateral wellbore section 1430. Those skilled in the art appreciate the steps necessary to fracture the lower lateral wellbore section 1430. After fracturing the lower lateral wellbore section 1430, a lower lateral wellbore barrier plug 2110 may be placed therein. At this stage, the deflector ramp 1515 is triggered from the third (③) fully closed position to the first (①) open position, while the deflector ramp 1555 remains triggered from the first (①) open position toward the second (②) partially closed position.

Figure 22:
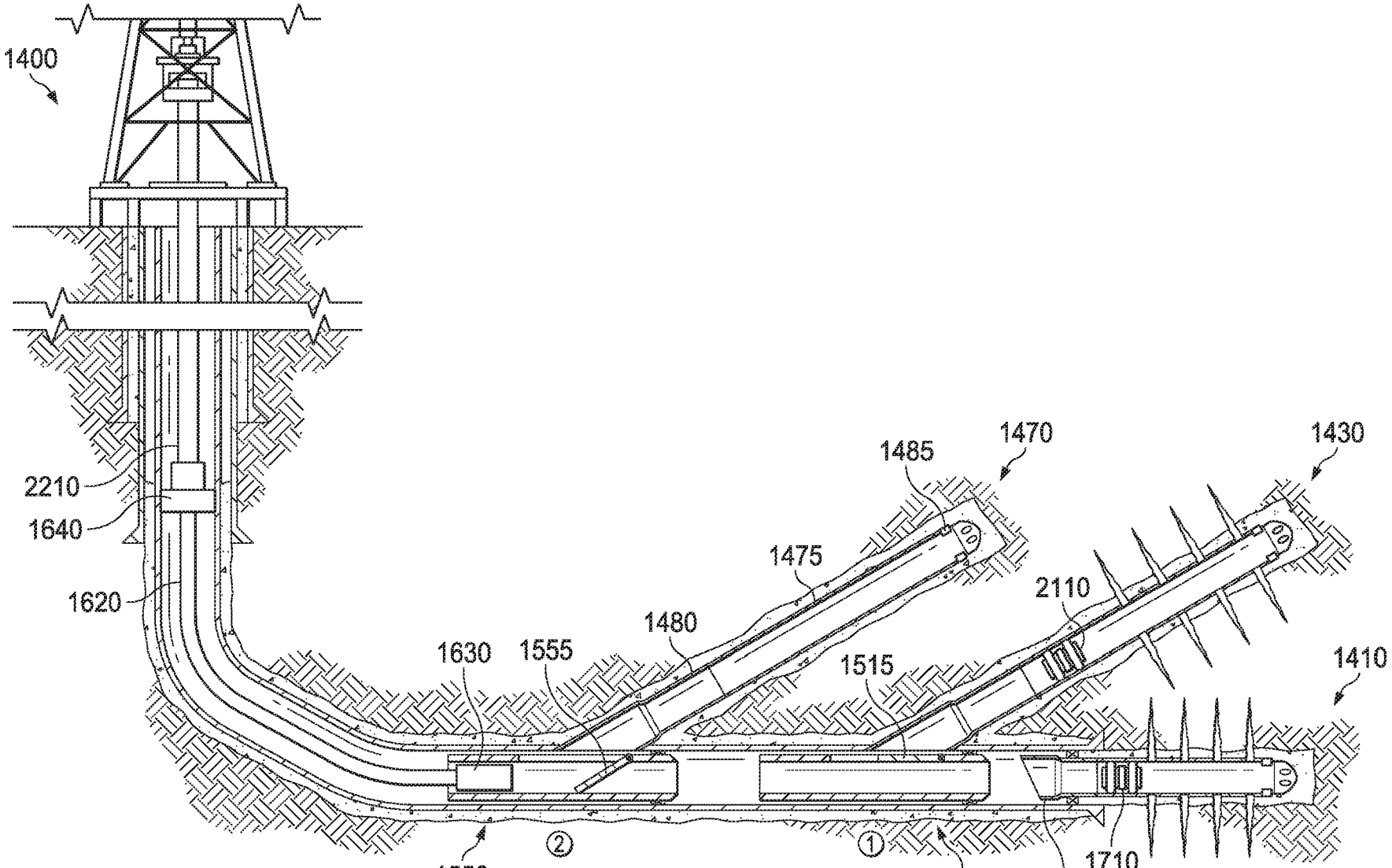

Turning to FIG. 22, illustrated is the multilateral well 1400 of FIG. 21 after attaching a downhole tool 2210 to the junction isolation tool 1620, and then withdrawing the junction isolation tool 1620 from the lower lateral wellbore section 1430 and just uphole of the deflector ramp 1555 in the upper lateral deflector assembly 1550. In accordance with one embodiment of the disclosure, as the junction isolation tool 1620 pulls out of the lower lateral wellbore section 1430, the deflector ramp 1515 is no longer propped closed by the junction isolation tool 1620, and thus the deflector ramp 1515 rotates to the first (①) open position. In accordance with one embodiment of the disclosure, as the junction isolation tool 1620 continues uphole and passes uphole of the deflector ramp 1555, the deflector ramp 1555 is no longer propped open by the junction isolation tool 1620, and thus the deflector ramp 1555 rotates fully to the second (②) partially closed position. At this stage, the deflector ramp 1515 is in the first (①) open position, while the deflector ramp is in the second (②) partially closed position.

Figure 23:
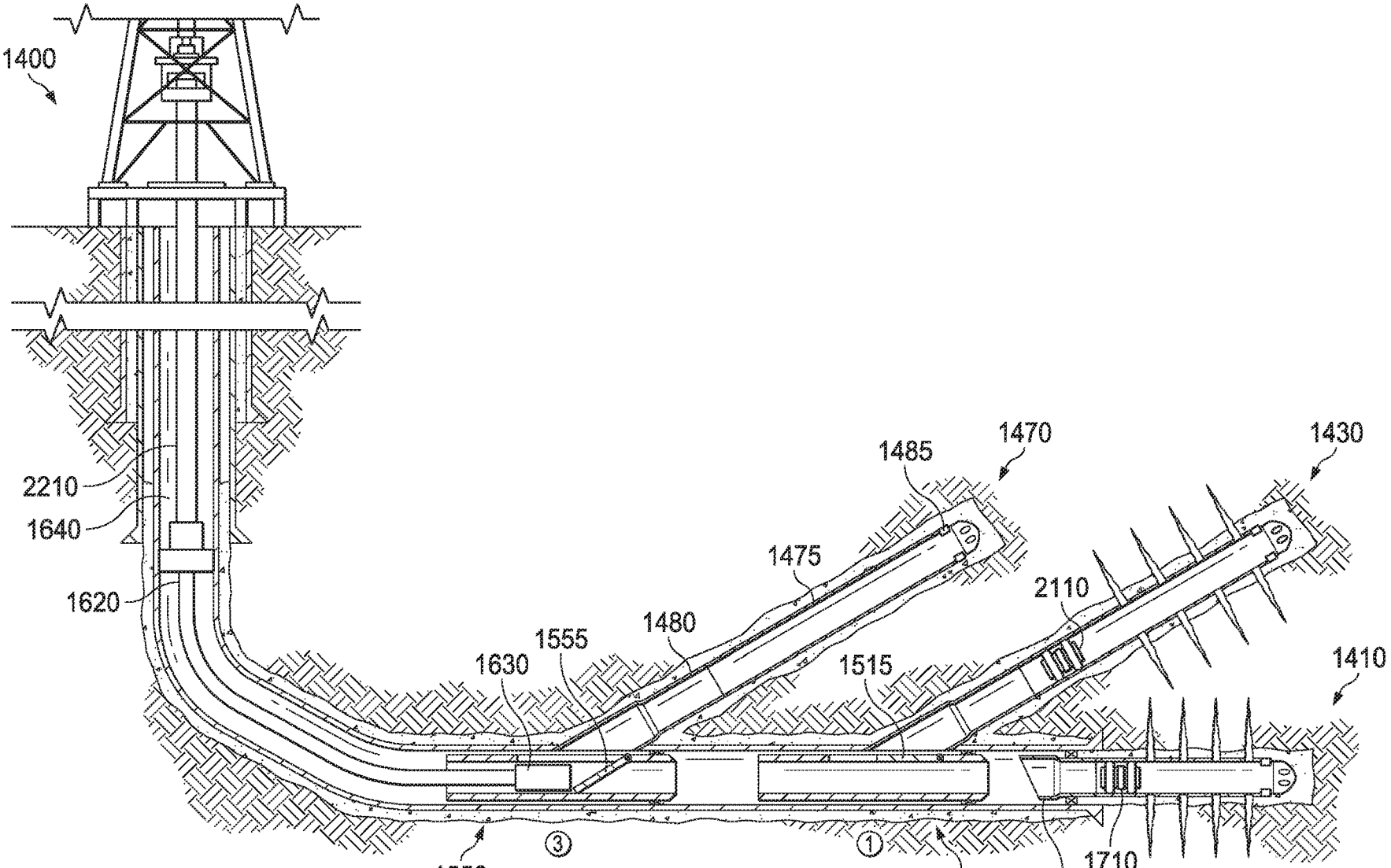

Turning to FIG. 23, illustrated is the multilateral well 1400 of FIG. 22 after pushing the downhole tool 2210 and junction isolation tool 1620 downhole until such time the junction isolation tool 1620 engages the deflector ramp 1555. Continued pushing of the downhole tool 2210 and junction isolation tool 1620 causes the junction isolation tool 1620 to move the deflector ramp 1555 to the third (③) fully closed position, while the deflector ramp 1515 remains in the first (①) open position.

Figure 24:
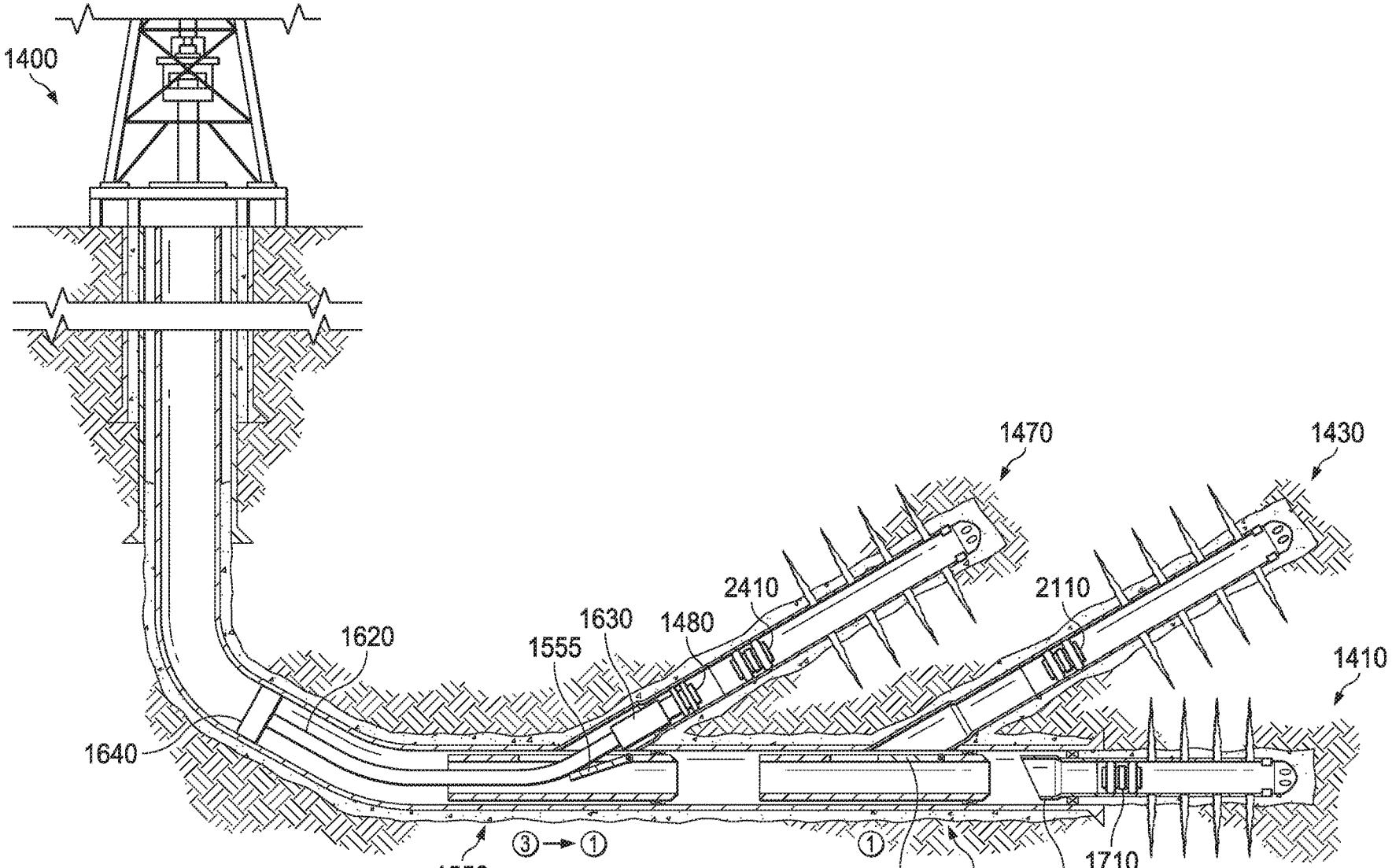

Turning to FIG. 24, illustrated is the multilateral well 1400 of FIG. 23 after continuing pushing the downhole tool 2210 and junction isolation tool 1620 downhole until such time the junction isolation tool 1620 exits the main wellbore section 1410 and enters the upper lateral wellbore section 1470. In the illustrated embodiment of FIG. 24, the shrouded seal assembly 1630 engages with the upper lateral receptacle and seal bore 1480. Further to FIG. 24, the junction isolation tool 1620 has been disconnected, and the upper lateral wellbore section 1470 has been fractured. Those skilled in the art appreciate the steps necessary to fracture the upper lateral wellbore section 1470. After fracturing the upper lateral wellbore section 1470, an upper lateral barrier plug 2410 may be placed therein. At this stage, the deflector ramp 1555 is triggered from the third (③) fully closed position toward the first (①) open position, while the deflector ramp 1515 remains in the first (①) open position. As the junction isolation tool 1620 remains within the upper lateral wellbore section 1470, the deflector ramp 1555 cannot rotate to the first (①) open position.

Figure 25:
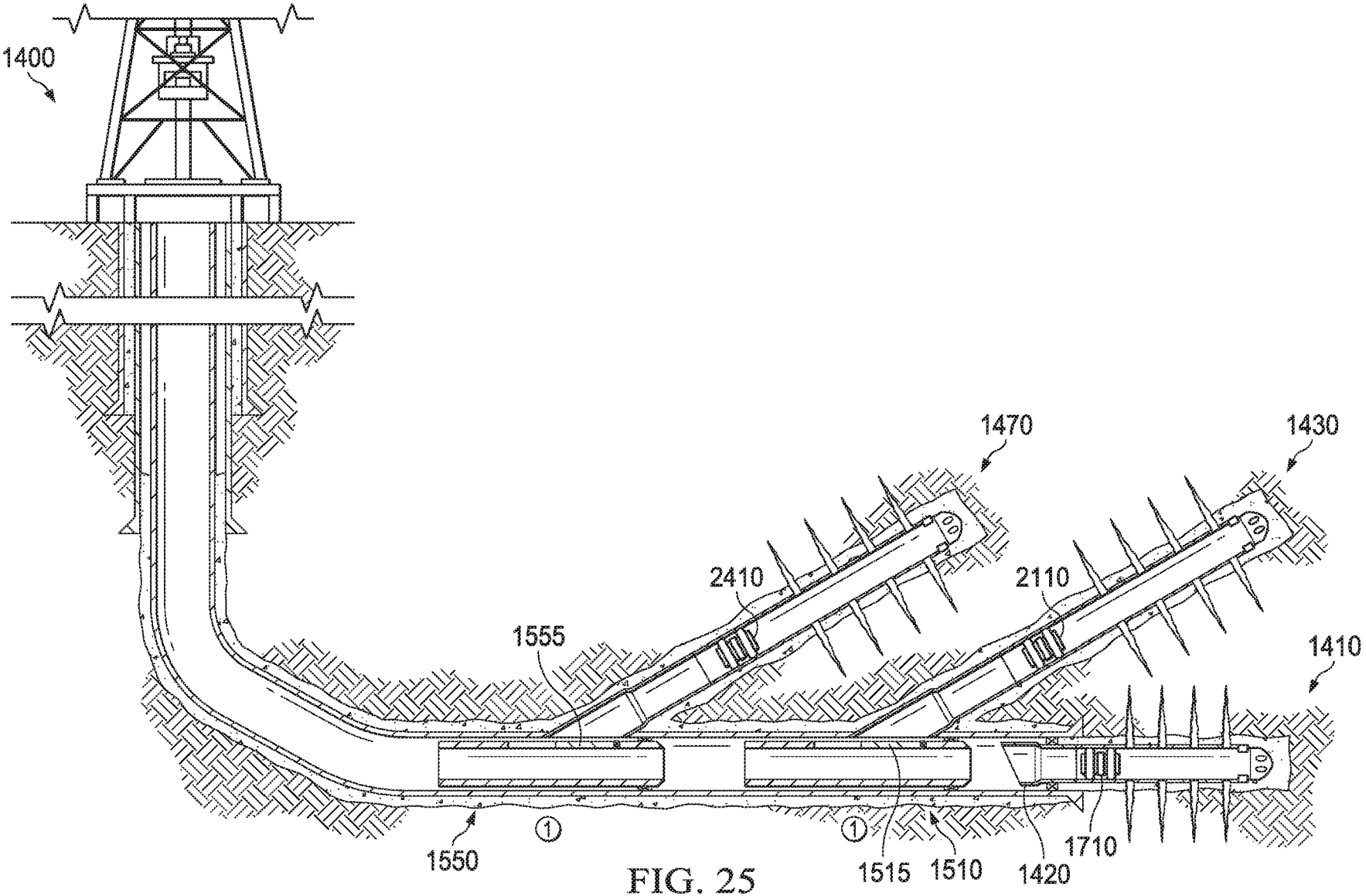
Figure 26:
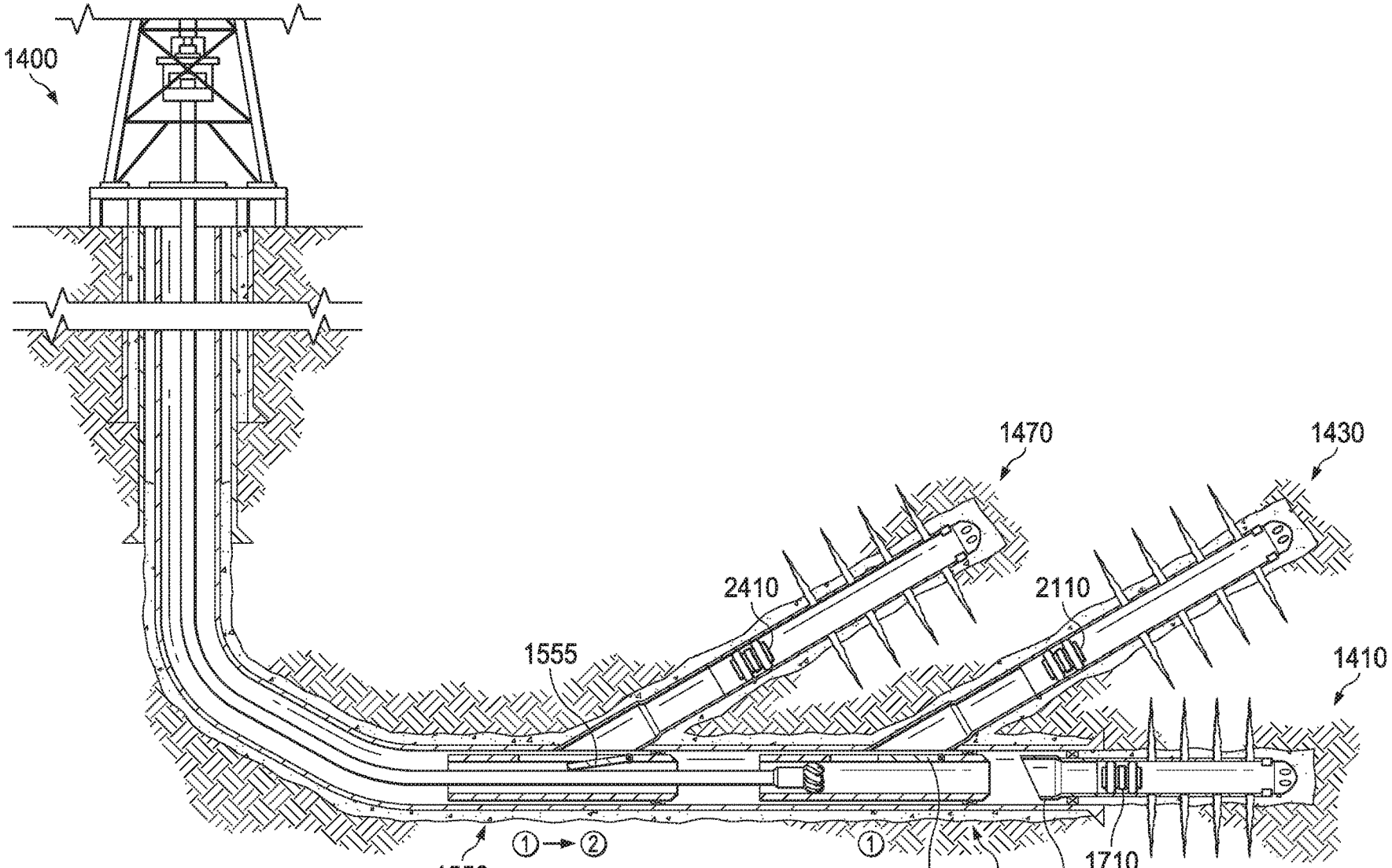
Figure 27:
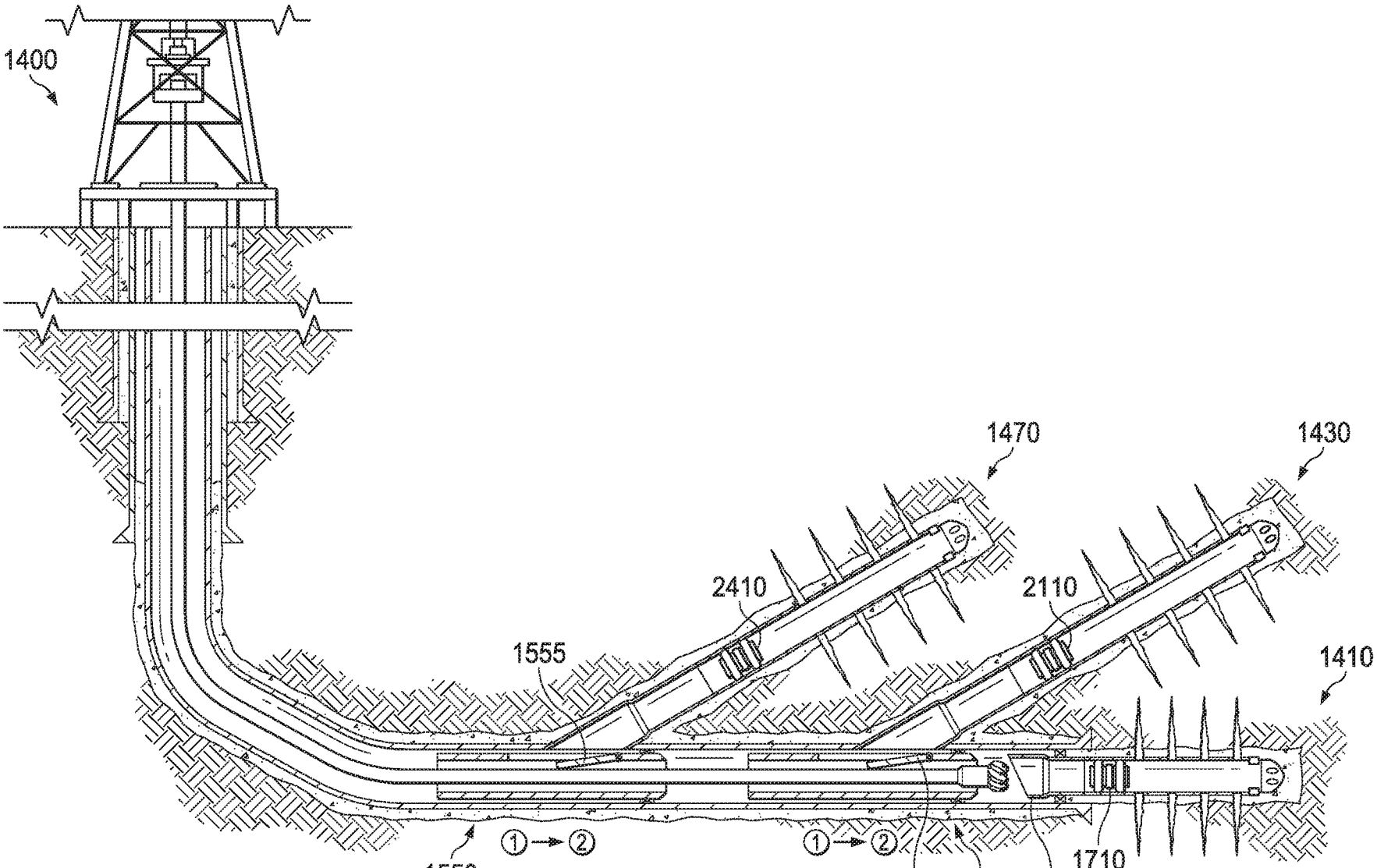
Figure 28:
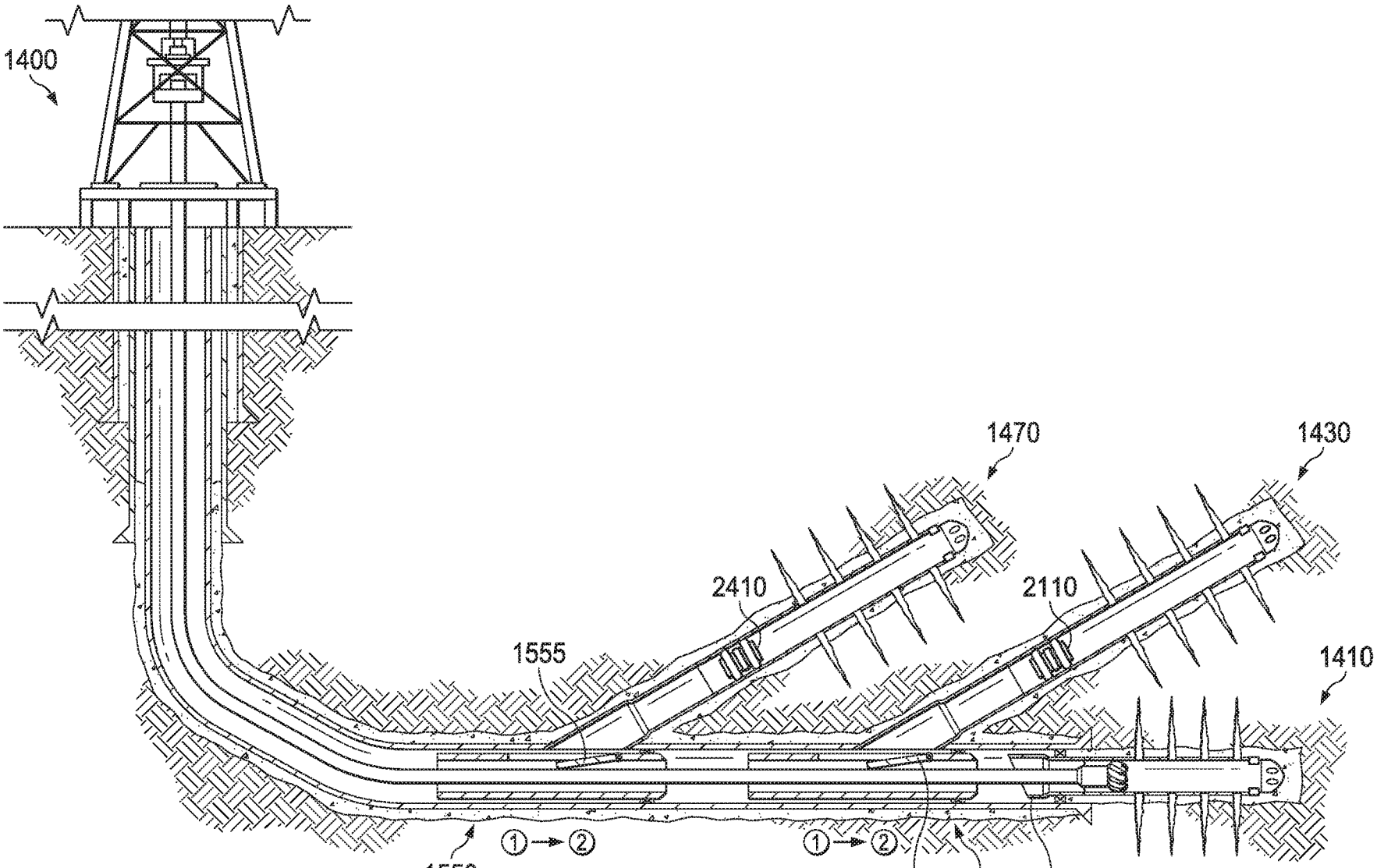
Figure 29:
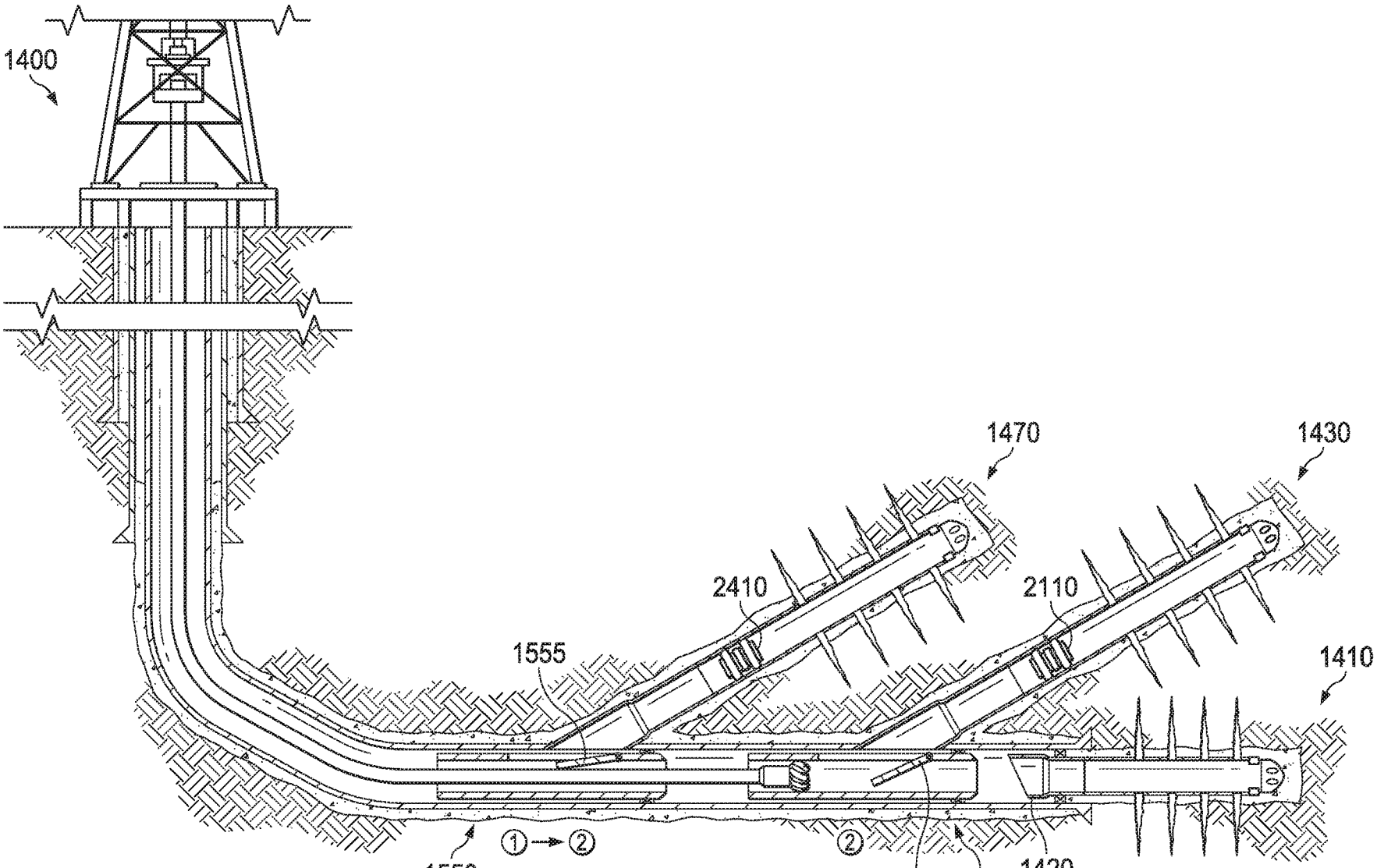
Figure 30:
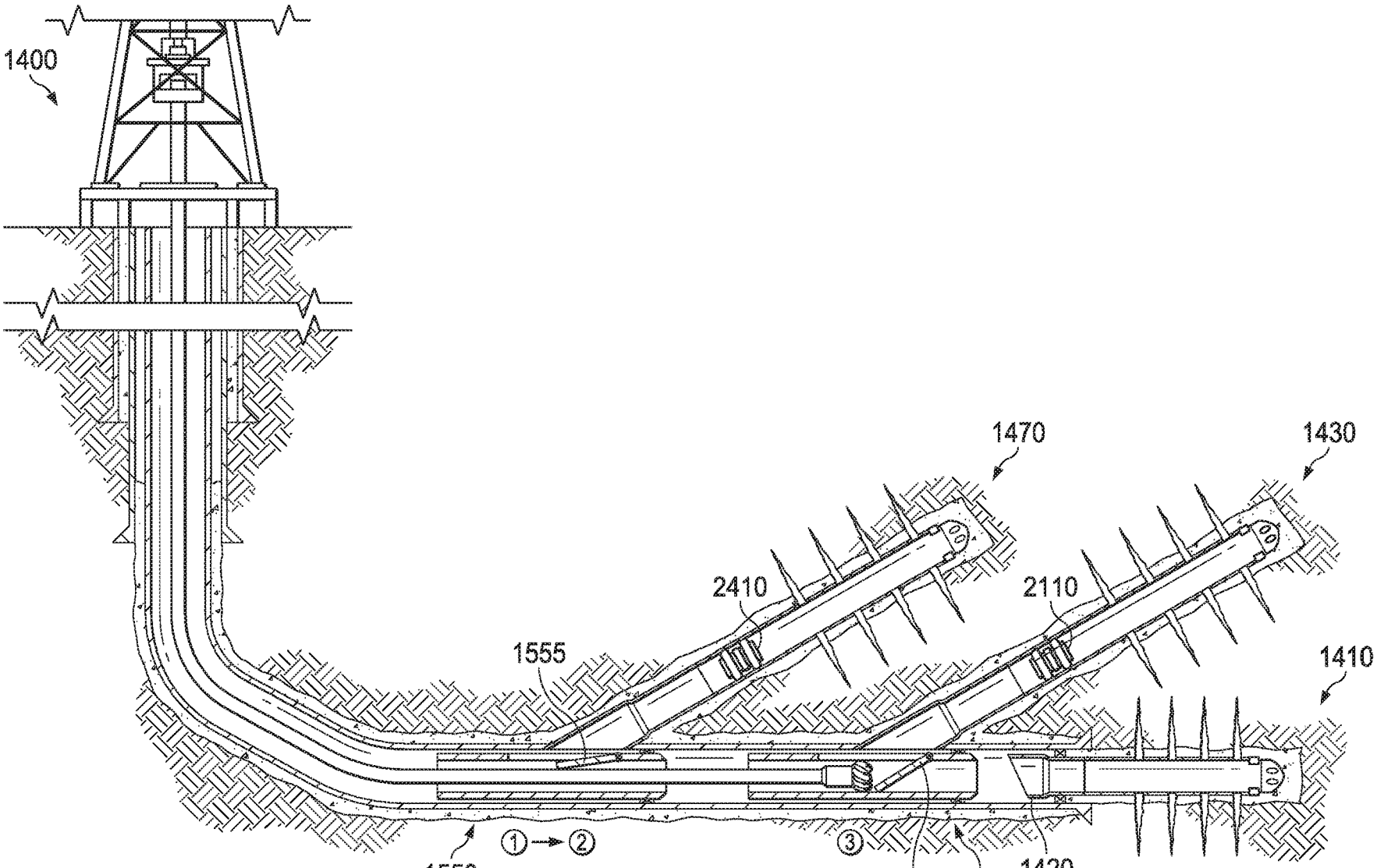
Figure 31:
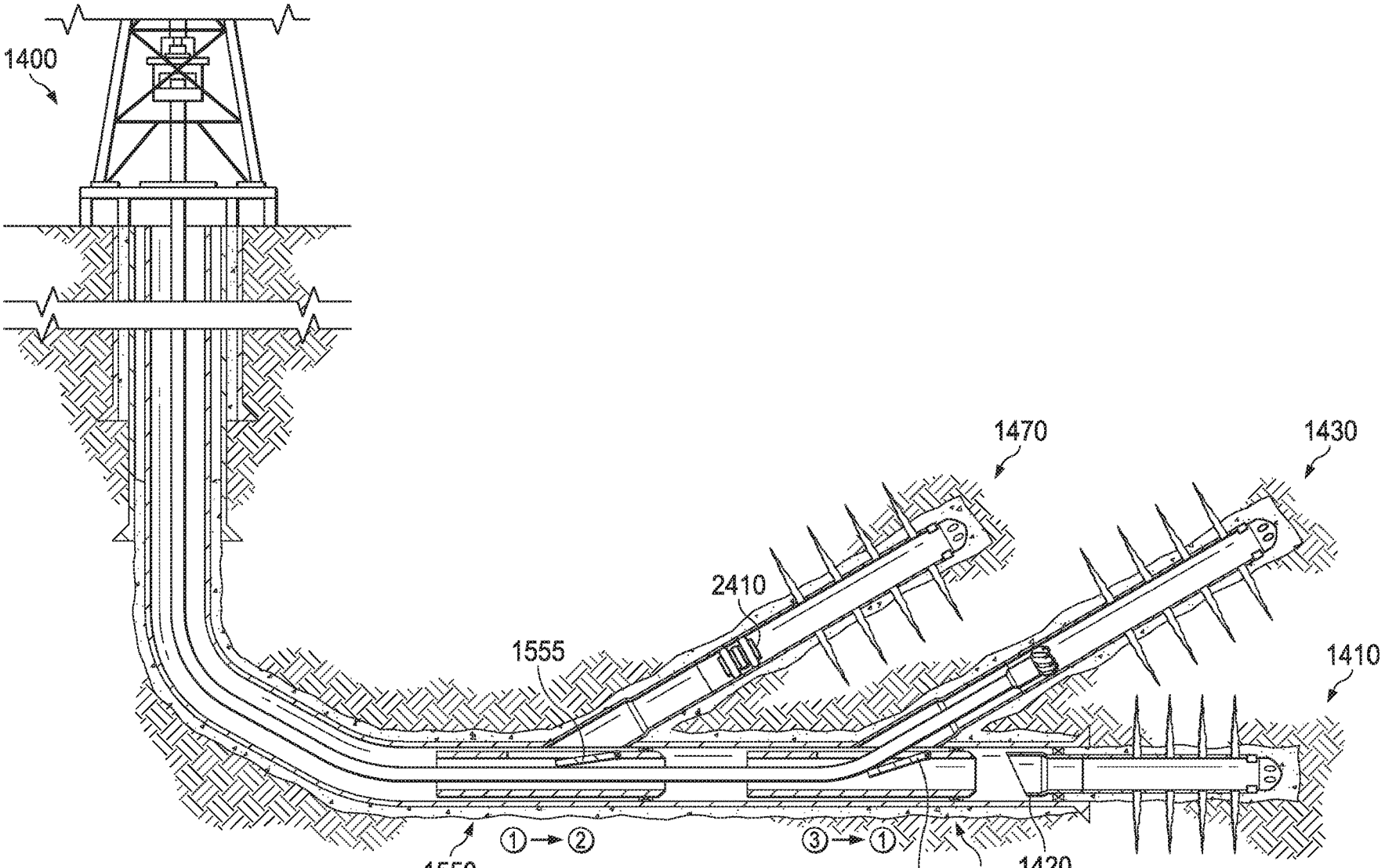
Figure 32:
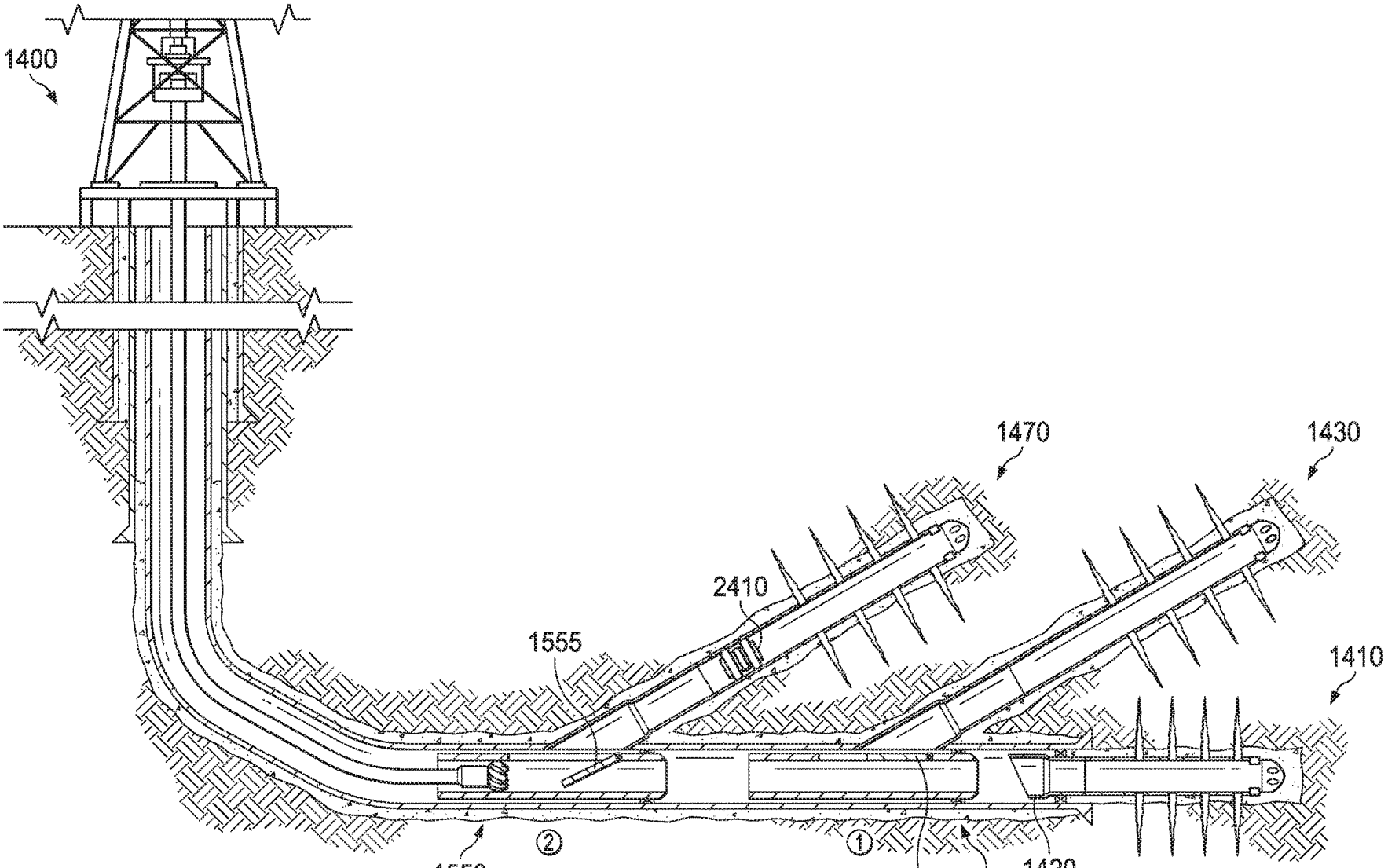
Figure 33:
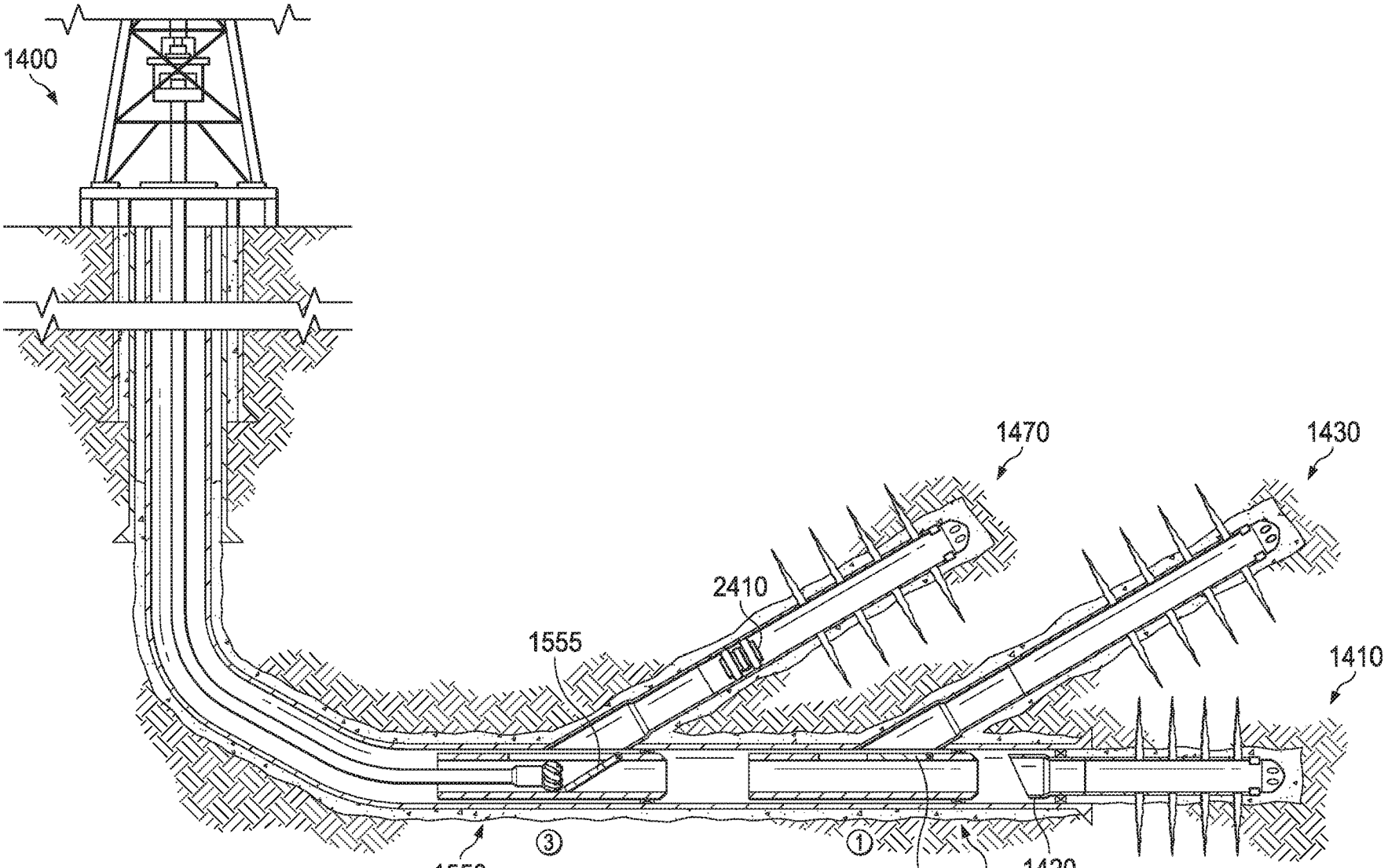
Figure 34:
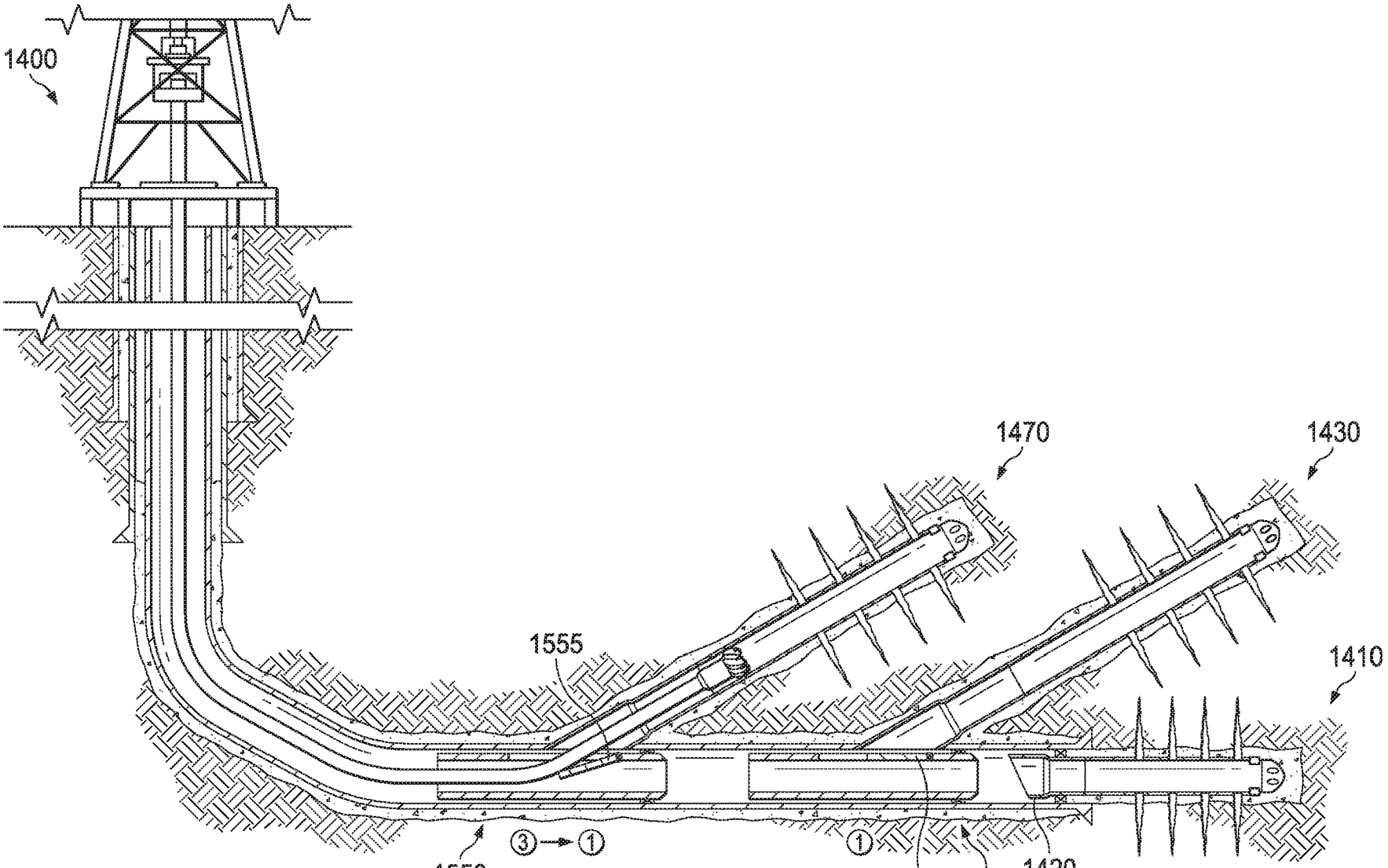
Figure 35:
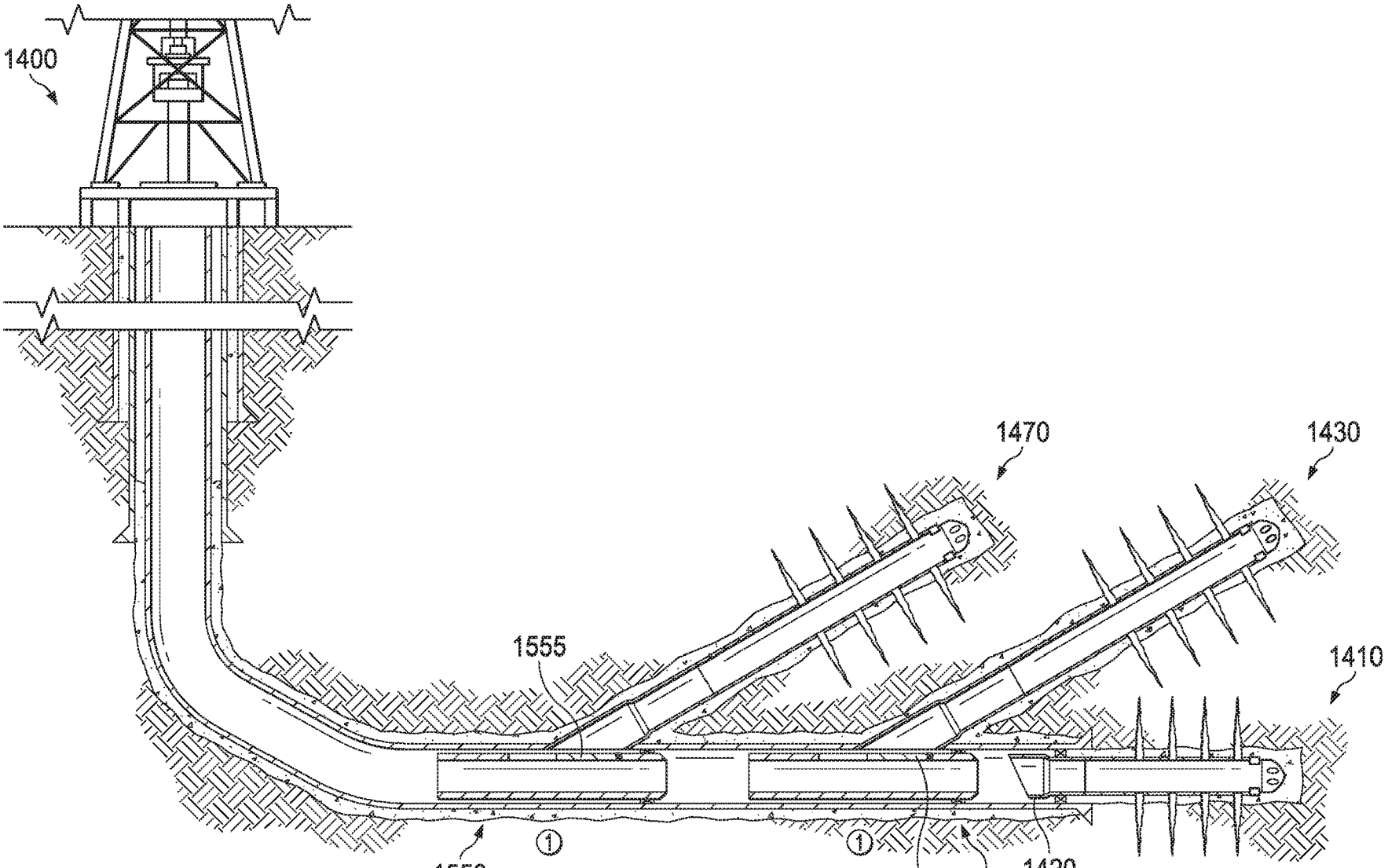

Turning to FIG. 25, illustrated is the multilateral well 1400 of FIG. 24 after attaching a downhole tool to the junction isolation tool 1620, and then pulling the downhole tool and junction isolation tool 1620 out of the well. At this stage, the main wellbore 1410 section, lower lateral wellbore section 1430 and upper lateral wellbore section 1470 are all fractured and plugged. Furthermore, at this stage the deflector ramp 1515 and deflector ramp 1555 each remain in the first (①) open position. With the deflector ramp 1515 and the deflector ramp 1555 each in the first (①) open position, one or more different downhole tools may enter the well and begin the process of actuating the lower lateral deflector assembly 1515 and upper lateral deflector assembly 1550 again.

Figure 36:
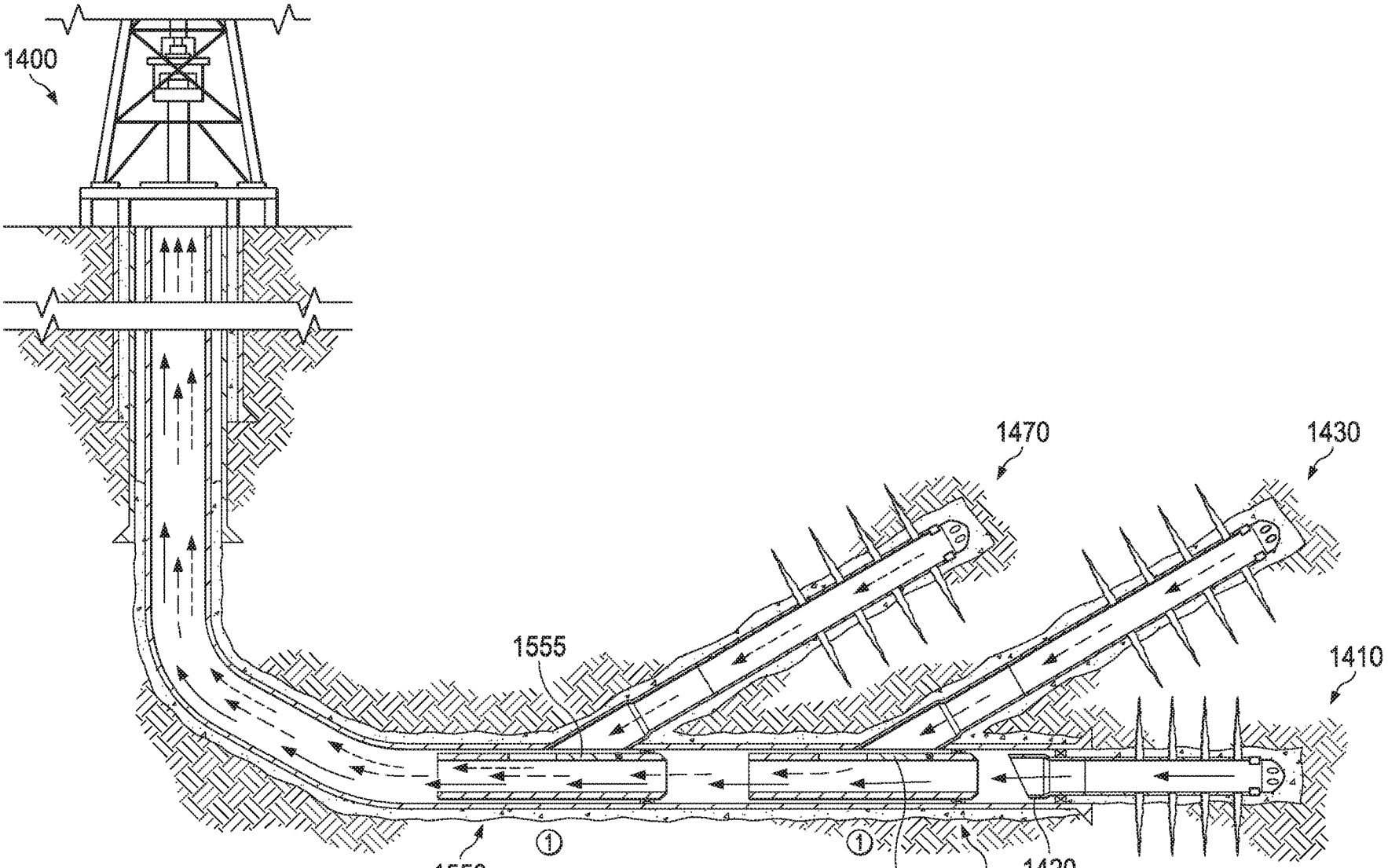

Turning momentarily to FIGS. 26-35, illustrated is a process flow for using the lower lateral deflector assembly 1515 and upper lateral deflector assembly 1550 to remove the main wellbore barrier plug 1710, lower lateral wellbore barrier plug 2110 and upper lateral wellbore barrier plug 2410. Given the foregoing disclosure, those skilled in the art understand the process for removal of the main wellbore barrier plug 1710, lower lateral wellbore barrier plug 2110 and upper lateral wellbore barrier plug 2410, including actuating the deflector ramps 1515, 1555 of the lower lateral deflector assembly 1515 and upper lateral deflector assembly 1550, respectively, between the first (①), second (②) and third (③) positions. Turning finally to FIG. 36, illustrated is the multilateral well 1400 of FIG. 35 producing fluid (e.g., oil, gas and/or water) from each of the main wellbore 1410 section, lower lateral wellbore section 1430 and upper lateral wellbore section 1470.

The process flow described above with regard to FIGS. 12-36 is based upon a plug and perforation workflow. In an alternative embodiment, the overall process can be simplified by employing a ball drop and frac sleeve workflow instead of the plug and perforation workflow. The ball drop and frac sleeve workflow avoids the need for a zipper frac scenario. Instead efficient is achieved by continuously fracturing each entire lateral stage in one go.

Figure 37:
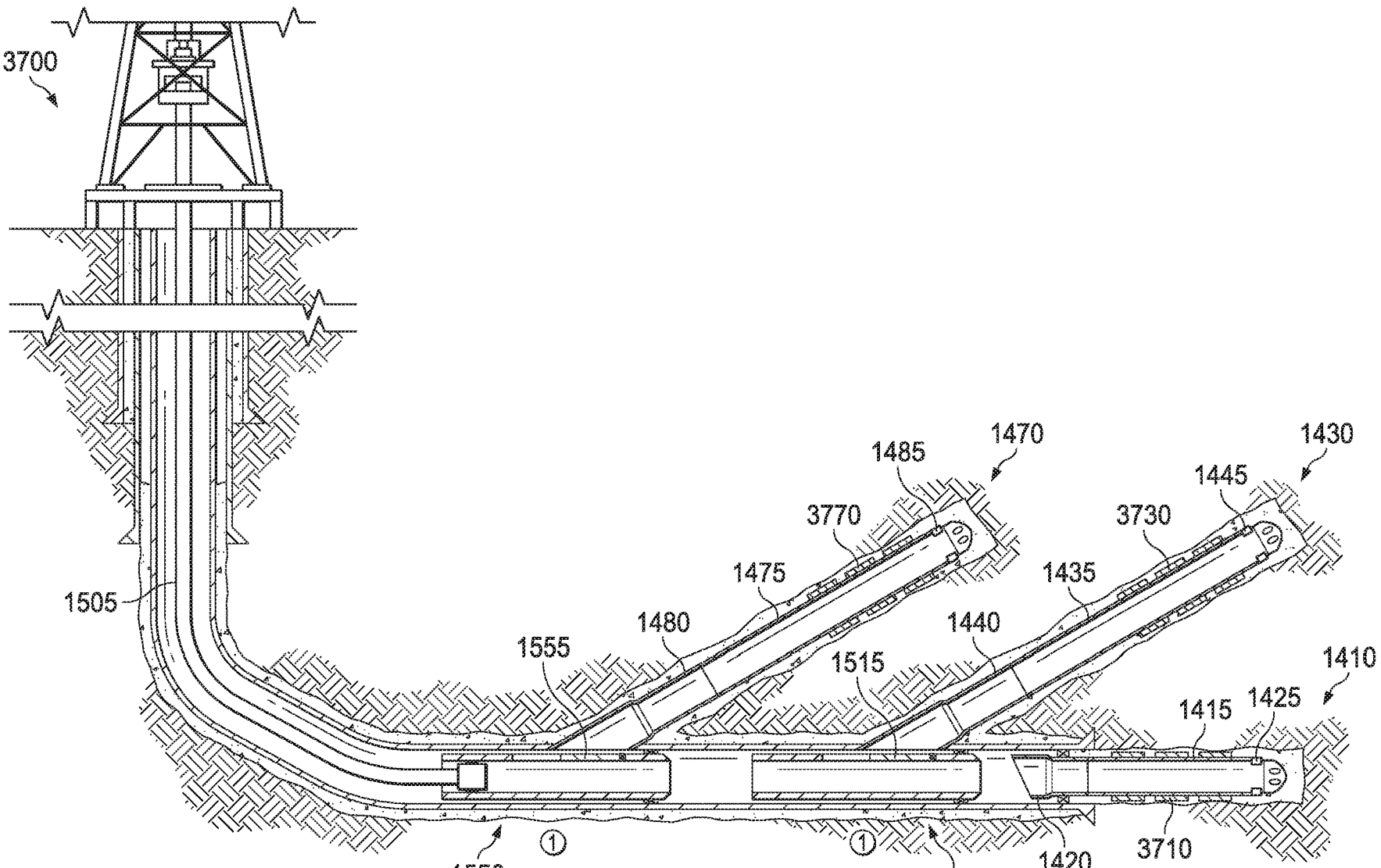
FIG. 37 illustrates a multilateral well designed, manufactured and operated according to another embodiment of the disclosure.

Turning briefly to FIG. 37, illustrated is a multilateral well 3700 designed, manufactured and operated according to another embodiment of the disclosure. The multilateral well 3700 is similar in many respects to the multilateral well 1400 illustrated in FIG. 15. Accordingly, like reference numbers have been used to represent similar (if not identical) features. The multilateral well 3700 differs, for the most part, from the multilateral well 1400 illustrated in FIG. 15 in that the multilateral well 3700 includes sliding frac sleeves 3710, 3730, 3770 in each of the main wellbore liner 1415, lower lateral wellbore liner 1435 and upper lateral wellbore liner 1475, respectively.

In this workflow sequence, the last operation with the drilling rig is to run the deflector assemblies 1510, 1550, as shown in FIG. 37. Afterwards, the drilling rig is rigged down and demobilized. With the well suspended, the wellhead is rigged up and a coil tubing and fracturing rig is mobilized on top of the wellhead.

A fracturing tip may then be run downhole via the coil tubing. The deflector assemblies 1510, 1550 may then be used as discussed above with regard to FIGS. 14-25 to move into and out of the main lateral wellbore section 1410, lower lateral wellbore section 1430 and upper lateral wellbore section 1470. Once the fracturing tip is positioned in one of the main lateral wellbore section 1410, lower lateral wellbore section 1430 or upper lateral wellbore section 1470, a series of dissolvable drop balls may be dropped to sequentially shift the necessary sliding frac sleeves and fracture the intended wellbore section.

Accordingly, each wellbore section (e.g., the main lateral wellbore section 1410, lower lateral wellbore section 1430 or upper lateral wellbore section 1470) is fractured in one continuous sequence, which enables a much more efficient fracturing operation. Additionally, re-positioning the frac tip to another lateral is performed seamlessly using the deflector assemblies 1510, 1550 without any change on the surface. Moreover, since coil tubing is snubbed under pressure, there is no need for setting and removing the isolation plugs 1710, 2110, 2410 set in the lateral after fracturing, which again enables a much more efficient fracturing operation.

Aspects disclosed herein include:

A. A deflector assembly, the deflector assembly including: a deflector body having a deflector window located therein, and a deflector ramp positioned at least partially across the deflector window, the deflector ramp configured to move between first (①), second (②) and third (③) different positions when a downhole tool moves back and forth within the deflector body.

B. A method for forming a multilateral well, the method including: 1) placing a deflector assembly proximate an intersection between a main wellbore and a lateral wellbore, the deflector assembly including a) a deflector body having a deflector window located therein, and b) a deflector ramp positioned at least partially across the deflector window, the deflector ramp configured to move between first (①), second (②) and third (③) different positions; 2) running a downhole tool past the deflector assembly to the main wellbore, thereby triggering the deflector ramp to move from the first (①) position toward the second (②) position; 3) withdrawing the downhole tool uphole of the deflector ramp without pulling the downhole tool out of the multilateral well, thereby allowing the deflector ramp to rest at the second (②) position; 4) pushing the downhole tool in contact with the deflector ramp resting at the second (②) position, thereby moving the deflector ramp from the second (②) position to the third (③) position; 5) sliding the downhole tool into the lateral wellbore, thereby triggering the deflector ramp to move from the third (③) position toward the first (①) position; and 6) withdrawing the downhole tool uphole of the deflector ramp, thereby allowing the deflector ramp to return to the first (①) position from the third (③) position.

C. A multilateral well, the multilateral well including: 1) a main wellbore; 2) a lateral wellbore extending from the main wellbore; and 3) a deflector assembly located proximate an intersection between the main wellbore and the lateral wellbore, the deflector assembly including a) a deflector body having a deflector window located therein, and b) a deflector ramp positioned at least partially across the deflector window, the deflector ramp configured to move between first (①), second (②) and third (③) different positions when a downhole tool moves back and forth within the deflector body.

Aspects A, B, and C may have one or more of the following additional elements in combination: Element 1: further including an actuation member positioned within the deflector body, the actuation member configured to move the deflector ramp between the first (①), second (②) and third (③) different positions. Element 2: wherein the actuation member includes an inner sleeve configured to engage with the deflector ramp at a downhole end thereof, the inner sleeve configured to move the deflector ramp between the first (①), second (②) and third (③) different positions. Element 3: wherein the inner sleeve includes a slot therein for following a cycle ring rotationally coupled to the deflector body. Element 4: wherein the slot is a J-slot that allows the inner sleeve to translate but not rotate relative to the deflector body. Element 5: further including an inner sleeve spring positioned between the deflector body and a profile of the inner sleeve, the inner sleeve spring configured to bias the inner sleeve toward the deflector ramp. Element 6: wherein the inner sleeve includes a collet section having a shifting profile extending radially inward therefrom, the shifting profile configured to catch a profile in the downhole tool. Element 7: wherein the collet section is operable to flex radially outward into a recess in the deflector body to allow the downhole tool to pass through the deflector assembly. Element 8: wherein the inner sleeve includes a locking feature extending from an outer surface thereof, the locking feature operable to engage/disengage with a profile in the deflector body. Element 9: further including a deflector ramp spring coupled to the deflector ramp for biasing the deflector ramp toward an interior of the deflector body. Element 10: wherein the first position is a first open (①) position, the second (②) position is a second (③) partially closed position, and the third (②) position is a third (③) fully closed position. Element 11: wherein the downhole tool is a junction isolation tool, and further including fracturing the main wellbore after running the junction isolation tool past the deflector assembly to the main wellbore and before withdrawing the junction isolation tool uphole of the deflector ramp without pulling the junction isolation tool out of the multilateral well. Element 12: further including placing a main wellbore isolation plug in the main wellbore using the junction isolation tool after fracturing the main wellbore and before withdrawing the junction isolation tool uphole of the deflector ramp without pulling the junction isolation tool out of the multilateral well. Element 13: further including fracturing the lateral wellbore after sliding the downhole tool into the lateral wellbore. Element 14: further including placing a lateral wellbore isolation plug in the lateral wellbore using the junction isolation tool after fracturing the lateral wellbore. Element 15: further including pulling the junction isolation tool out of the multilateral well after placing the lateral wellbore isolation plug in the lateral wellbore, and then running a second downhole tool within the multilateral well, the second downhole tool using the deflector assembly to remove the main wellbore barrier plug and then the lateral wellbore barrier plug. Element 16: further including an actuation member positioned within the deflector body, the actuation member including an inner sleeve configured to engage with the deflector ramp at a downhole end thereof and move the deflector ramp between the first (①), second (②) and third (③) different positions. Element 17: wherein the inner sleeve includes a J-slot therein for following a cycle ring rotationally coupled to the deflector body.

Those skilled in the art to which this application relates will appreciate that other and further additions, deletions, substitutions and modifications may be made to the described embodiments.

What is claimed is:

1. A deflector assembly, comprising:

a deflector body having a deflector window located therein;

a deflector ramp positioned at least partially across the deflector window, the deflector ramp configured to be positioned at first, second and third different positions; and an actuation member positioned within the deflector body, the actuation member including an inner sleeve configured to slide within the deflector body downhole of the deflector ramp and engage with the deflector ramp proximate a downhole end thereof, the inner sleeve configured to hold the deflector ramp at the first and the second different positions when a downhole tool moves back and forth within the deflector body.

2. The deflector assembly as recited in claim 1, wherein the inner sleeve includes a slot therein for following a cycle ring rotationally coupled to the deflector body.

3. The deflector assembly as recited in claim 2, wherein the slot is a J-slot that allows the inner sleeve to translate but not rotate relative to the deflector body.

4. The deflector assembly as recited in claim 1, further including an inner sleeve spring positioned between the deflector body and a profile of the inner sleeve, the inner sleeve spring configured to bias the inner sleeve toward the deflector ramp.

5. The deflector assembly as recited in claim 1, wherein the inner sleeve includes a collet section having a shifting profile extending radially inward therefrom, the shifting profile configured to catch a profile in the downhole tool.

6. The deflector assembly as recited in claim 5, wherein the collet section is operable to flex radially outward into a recess in the deflector body to allow the downhole tool to pass through the deflector assembly.

7. The deflector assembly as recited in claim 1, wherein the inner sleeve includes a locking feature extending from an outer surface thereof, the locking feature operable to engage/disengage with a profile in the deflector body.

8. The deflector assembly as recited in claim 1, further including a deflector ramp spring coupled to the deflector ramp for biasing the deflector ramp toward an interior of the deflector body.

9. The deflector assembly as recited in claim 1, wherein the deflector ramp rotates about an axis located proximate a downhole end of the deflector window.

10. A method for forming a multilateral well, comprising:

placing a deflector assembly proximate an intersection between a main wellbore and a lateral wellbore, the deflector assembly including;

a deflector body having a deflector window located therein;

a deflector ramp positioned at least partially across the deflector window; and an actuation member positioned within the deflector body, the actuation member including an inner sleeve configured to slide within the deflector body and engage with the deflector ramp proximate a downhole end thereof, the inner sleeve configured to move the deflector ramp between first, second and third different positions;

running a downhole tool past the deflector assembly to the main wellbore, thereby triggering the actuation member to allow the deflector ramp to move from the first position toward the second position;

withdrawing the downhole tool uphole of the deflector ramp without pulling the downhole tool out of the multilateral well, the actuation member allowing the deflector ramp to rest at the second position;

pushing the downhole tool in contact with the deflector ramp resting at the second position and out into the lateral wellbore, thereby pushing the deflector ramp from the second position to the third position and triggering the actuation member to allow the deflector ramp to move from the third position toward the first position; and withdrawing the downhole tool uphole of the deflector ramp, thereby allowing the deflector ramp to return to the first position from the third position.

11. The method as recited in claim 10, wherein the first position is a first open position, the second position is a second partially closed position, and the third position is a third fully closed position.

12. The method as recited in claim 10, wherein the downhole tool is a junction isolation tool, and further including fracturing the main wellbore after running the junction isolation tool past the deflector assembly to the main wellbore and before withdrawing the junction isolation tool uphole of the deflector ramp without pulling the junction isolation tool out of the multilateral well.

13. The method as recited in claim 12, further including placing a main wellbore isolation plug in the main wellbore using the junction isolation tool after fracturing the main wellbore and before withdrawing the junction isolation tool uphole of the deflector ramp without pulling the junction isolation tool out of the multilateral well.

14. The method as recited in claim 13, further including fracturing the lateral wellbore after sliding the downhole tool into the lateral wellbore.

15. The method as recited in claim 14, further including placing a lateral wellbore isolation plug in the lateral wellbore using the junction isolation tool after fracturing the lateral wellbore.

16. The method as recited in claim 15, further including pulling the junction isolation tool out of the multilateral well after placing the lateral wellbore isolation plug in the lateral wellbore, and then running a second downhole tool within the multilateral well, the second downhole tool using the deflector assembly to remove the main wellbore barrier plug and then the lateral wellbore barrier plug.

17. The method as recited in claim 10, wherein the deflector ramp rotates about an axis located proximate a downhole end of the deflector window.

18. A multilateral well, comprising:

a main wellbore;

a lateral wellbore extending from the main wellbore; and a deflector assembly located proximate an intersection between the main wellbore and the lateral wellbore, the deflector assembly including;

a deflector body having a deflector window located therein; and a deflector ramp positioned at least partially across the deflector window, the deflector ramp configured to be positioned at first, second and third different positions; and an actuation member positioned within the deflector body, the actuation member including an inner sleeve configured to slide within the deflector body downhole of the deflector ramp and engage with the deflector ramp proximate a downhole end thereof, the inner sleeve configured to hold the deflector ramp at the first and the second different positions when a downhole tool moves back and forth within the deflector body.

19. The multilateral well as recited in claim 18, wherein the inner sleeve includes a J-slot therein for following a cycle ring rotationally coupled to the deflector body.

20. The multilateral well as recited in claim 18, wherein the deflector ramp rotates about an axis located proximate a downhole end of the deflector window.

* * * * *